US005582410A

United States Patent [19]

Hunt

[11] Patent Number: 5,582,410

[45] Date of Patent: Dec. 10, 1996

[54] MULTI-PLAYER CHESS GAME

[76] Inventor: Aaron A. Hunt, 5418 Bethesda La., Indianapolis, Ind. 46254

[21] Appl. No.: 562,415

[22] Filed: Nov. 24, 1995

[51] Int. Cl.[6] ..... A63F 3/02

[52] U.S. Cl. ..... 273/261

[58] Field of Search ..... 273/242, 255, 273/260, 261, 262

[56] References Cited

U.S. PATENT DOCUMENTS

| | | | |
|---|---|---|---|
| D. 231,848 | 6/1974 | Mobert | D34/5 SS |
| 3,533,627 | 10/1970 | Deffenbaugh . | |
| 3,724,856 | 4/1973 | Welch | 273/261 |
| 3,744,797 | 7/1973 | Hopkins . | |
| 3,778,065 | 12/1973 | Hale | 273/261 |
| 3,836,149 | 9/1974 | Adams et al. | 273/261 |
| 3,840,237 | 10/1974 | Shkolnik . | |
| 3,920,247 | 11/1975 | Jenkins | 273/261 |
| 3,963,242 | 6/1976 | Treugut et al. . | |
| 3,964,747 | 6/1976 | Balmforth | 273/261 |
| 4,249,741 | 2/1981 | Buijtendorp | 273/261 |
| 4,580,787 | 4/1986 | Baker | 273/261 |
| 4,653,759 | 3/1987 | Anderson | 273/261 |
| 5,158,302 | 10/1992 | Rewega | 273/261 |
| 5,209,488 | 5/1993 | Kimball | 273/261 |

FOREIGN PATENT DOCUMENTS

| | | | |
|---|---|---|---|
| 2033239 | 5/1980 | United Kingdom | 273/261 |
| 2225729 | 6/1990 | United Kingdom | 273/261 |

*Primary Examiner*—William E. Stoll
*Attorney, Agent, or Firm*—Eric R. Waldkoetter

[57] ABSTRACT

A chess game playable by two or more players is disclosed. The chess game is played upon polygonal spaces arranged substantially in the shape of an equilateral polygon. Two or more armies of chessmen are arranged on the chessboard. Additional chessmen are added to each army of chessmen, providing a balance of competition equivalent to the balance of competition inherent in traditional chess. The chess game is historically based on the events of the Great Schism of (1378–1417).

4 Claims, 32 Drawing Sheets

MULTI-PLAYER CHESS GAME

BACKGROUND

This invention relates to a chessboard game where participants compete in a contest of skill using contest elements which are manipulated according to rules on a patterned playing surface composed of a plurality of playing spaces. More particularly, each group of several contest elements are initially equal in number and equivalent in power to all other groups in the contest. The contest normally ends when one player captures and or traps the principal elements of the other player or players.

The history of chess probably began in India around the sixth century A.D. with a game named Chaturanga which means "four-armed", referring to the four branches of the Indian army: infantry, cavalry, elephants, and chariots. Some of today's chess pieces have evolved from these four branches; infantry—pawns, cavalry—knights, elephants—rooks, and chariots—bishops.

Modern chess is largely defined by Medieval history, For example, the pawn is representative of the medieval pikeman, or foot soldier, who carried a spear and a shield. Because of the shield, the pikeman struck out to either side of it during battle. So the pawn in chess captures not straight ahead, but diagonally to either side of the shield. The aggressive charge of the lance wielding knight is reflected in a game piece of great agility and power, having the ability to jump like a horse over other game pieces and to hold enemies at bay in a way no other piece can. Rooks represent the castle or home and bishops represent the church; these pieces work together in a manner symbolizing the strength of the bond of church and home. The queen, the only female piece, combines the movements of the rook and bishop (home and church) and is the most powerful piece in the game. The importance and austeriety of the king is reflected in a piece that usually does not participate directly in the battle but stands taller than all of his army, and is the focus of the principal objective of the game, namely the checkmate.

History and tradition remain an integral part of the game of chess and have limited the alterations to chess during recent centuries. Therefore adaptations of the game which depart from the history and traditions of chess have not been well received by the established chess community. This is particularly true with chess variations that introduce additional armies and additional players into the game. Therefore, in designing a multi-army chess game, perhaps the most difficult task is to maintain the integrity of the original historical basis of chess, its game objectives and nature of play, while introducing additional armies and players.

Playing Surface

In traditional chess the chessboard is square, the playing spaces are square, there are two different colors of playing spaces, and the game is played by two people, manipulating two armies of chessmen. The relationship of the traditional chessboard, playing spaces, and armies can be defined as follows:

| | |
|---|---|
| Number of sides on a chessboard | $= B;$ |
| Number of sides on a playing space | $= S;$ |
| Number of colors on chessboard | $= C;$ and |
| Number of armies | $= n.$ |

-continued $$\frac{S}{n} = \frac{4}{2} = 2 \quad \frac{B}{n} = \frac{4}{2} = 2$$

$$\frac{\frac{S}{n}}{\frac{B}{n}} = \frac{2}{2} = 1 \quad \frac{C}{n} = \frac{2}{2} = 1$$

The final result of the above relationship comparison is equal to one or unity.

Some prior art three-army chessboards have used quadrangles such as squares for spaces to create a playing surface. The playing surface also usually resembles a quadrangle. In a three-army chessboard that uses quadrangles relationship between the number of sides on a chessboard (B); the number of sides on a playing space (S); the number of colors on chessboard (C); and, the number of armies (n) can be expressed as follows:

$$\frac{S}{n} = \frac{4}{3} = 1.33 \quad \frac{B}{n} = \frac{6}{3} = 2$$

$$\frac{\frac{S}{n}}{\frac{B}{n}} = \frac{1.33}{2} = 0.66 \quad \frac{C}{n} = \frac{2}{3} = 0.66$$

The above relationships vary considerably from those expressed earlier for traditional chess. Moreover, the final result of the above relationships is equal to a disunity, namely 0.66. An example of a three-army chessboard that uses quadrangular shaped playing spaces is disclosed in U.S. Pat. Nos. 4,249,741 issued to Buijtendorp and U.S. Pat. No. 231,848 issued to Mobert.

Some prior art three-army chessboards have used triangles such as equilateral triangles for spaces to create a playing surface. In a three-army chessboard that uses triangular playing spaces the relationship between the number of sides on a chessboard (B); the number of sides on a playing space (S); the number of colors on chessboard (C); and, the number of armies (n) can be expressed as follows:

$$\frac{S}{n} = \frac{4}{2} = 1.33 \quad \frac{B}{n} = \frac{6}{3} = 2$$

$$\frac{\frac{S}{n}}{\frac{B}{n}} = \frac{1}{2} = 0.5 \quad \frac{C}{n} = \frac{2}{3} = 0.66$$

The above relationships vary considerably from those expressed earlier for traditional chess. Moreover, the results of the above relationships are equal to two disunities, namely 0.5 and 0.66. Examples of a three-army chessboard that uses triangular shaped playing spaces is disclosed in U.S. Pat. No. 3,963,242 issued to Treugut et al. and U.S. Pat. No. 3,533,627 issued to Deffenbaugh et al.

Some prior art three-army chessboards have used three quadrangular shaped playing surfaces joined together by a triangular shaped playing surface that allows for transition between the three rectangular shaped playing surfaces. The three quadrangular shaped playing surfaces also have quadrangular shaped playing spaces and the triangular shaped playing surface has triangular shaped playing spaces. Examples of three-army chessboards that use three quadrangular shaped playing surfaces joined together by a triangular shaped playing surface are disclosed in U.S. Pat. No. 5,209,488 issued to Kimball, U.S. Pat. No. 4,653,759 issued to Anderson et al., and U.S. Pat. No. 3,840,237 issued to Shkolnik.

Some prior art three-army chessboards have used hexagons for spaces to create a playing surface in the shape of an irregular six-sided polygon. Unlike a traditional chessboard, an irregular six-sided polygon does not have sides of equal length. Additionally, playing pieces are arrayed in three ranks rather than two ranks used in traditional chess. An example of a three-army chessboard that uses hexagon shaped playing spaces is disclosed in U.S. Pat. No. 3,744,797 issued to Hopkins.

What is needed is a playing surface composed of spaces in an overall pattern that permits chess to be played by multiple armies and maintains the geometric integrity of standard chess.

Rules and Objectives

In traditional chess, each of two players has one objective, and that objective is to checkmate the opponent's king. Another way to express the objective of traditional chess is as follows. In traditional chess two players control two armies, A and B, each of which have a king. The objective of army A is to checkmate army B's king, and the objective of army B is to checkmate army A's king. The above possible objectives in traditional chess produce the following table of objectives.

| | Objective |
|---|---|
| Army A | Checkmate Army B's King |
| Army B | Checkmate Army A's King |

The above table shows that the objective of traditional chess is for each army to checkmate the opposing army's king. Obviously there is balance of competition because each army has one unique target. The number of pads in the above table, four, is equal to the square of the number of armies, ($2^2$).

In a three-army chess game played by three players, an objective of cornering a single opponent is problematic because such an objective would permit two opponents to form an alliance against the third player. Another way to express the objectives of a three-army chess game where each player uses an army of traditional chessmen is as follows. The objective of army A is to checkmate army B's king or checkmate army C's king. The objective of army B is to checkmate army A's king or checkmate army C's king. The objective of army C is checkmate army A's king or checkmate army B's king. The following table shows the relationship of the above objectives.

| | Possible Objectives | |
|---|---|---|
| | One Objective | Another Objective |
| Army A | Army B's King | Army C's King |
| Army B | Army A's King | Army C's King |
| Army C | Army A's King | Army B's King |

The above possible objectives in a three-army chess game using a set of traditional chessmen per player produce the following combination of player objectives at any one time for any single game played. In the following table, AK, BK, and CK are used to designate the respective armies' kings.

| | Possible Objectives | | | | | | | |
|---|---|---|---|---|---|---|---|---|
| | 1 | 2 | 3 | 4 | 5 | 6 | 7 | 8 |
| Army A | BK | BK | BK | BK | CK | CK | CK | CK |
| Army B | CK | AK | AK | CK | AK | AK | CK | CK |
| Army C | AK | BK | AK | BK | BK | AK | AK | BK |

Only in situations one and five is the balance of competition maintained because each army has a different target. In situations two, three, four, six, seven, and eight, one of the targets appears twice. Thus, in the eight possible situations, six, or ¾, result in alliances. Furthermore, the total number of combination in the eight situations, forty-eight, is not equal to the square of the number of armies, ($3^2$). Therefore, a three-army chess game that uses the traditional chess array of pieces for each army results usually in the formation of alliances that significantly change the character of play from that of traditional chess.

Some prior art three-army chess games have rules that are similar to the rules of traditional two-army chess. A problem with using two-army chess rules in a three-army game is that two armies can enter into an alliance against the remaining army. Once the third army's king is checkmated, the third army no longer participates in the a contest.

Other prior art three-army chess games attempt to solve the alliance problem by setting up a point system. In some games alliances are discouraged by allowing the first king checkmated to be removed from the board and the losing king's army to become the property of the opposing army making the checkmate. In this case, the game continues without the checkmated opponent until another checkmate has been obtained. Such an arrangement is unappealing as it requires one army to withdraw and merely observe the remainder of the game. The climactic goal of checkmate and its sense of utter finality are thus entirely lost.

Some prior art three-army chess games have altered the game's objective slightly. One way to alter the game's objective is to introduce a new chess piece into the game called a Cardinal. The suggested purpose of the Cardinal is to is to save the game for an army who would otherwise be forced to resign and merely observe the remainder of the game. The same prior art three-army chess game that introduces the Cardinal also modifies checkmate of the king into a historical event which involves placing a ring around the king or a colored field under the king. This prior art three-army chess game seems to undermine the whole point of checkmate; the finality is lost. An example of a three-army chess game that introduces these elements is disclosed in U.S. Pat. No. 3,963,242 issued to Treugut et al.

Some prior art three-army chess games introduce a chance element such as the roll of a die presumably to make the three-army chess game more amusing. An example of a three-army chess game that introduces a chance element is disclosed in U.S. Pat. No. 4,653,759 issued to Anderson et al.

What is needed are rules and objectives which permit chess to be played with multiple armies while maintaining the traditions of standard chess.

SUMMARY

It is an object of the invention to add at least one additional chess piece to a traditional chess army that is equivalent in power and movement to a king.

It is an another object of the invention to create a playing surface for a multi-player chess game that maintains geometric relationships between armies analogous to those of traditional chess.

It is still another object of the invention to adapt the rules of traditional chess to a multi-player chess game which maintains an adversarial relationship among all armies for the duration of a game.

It is yet another object of the invention to retain same ratio of possible moves for the knight as is provided in regular chess and the knight's movement characteristic of moving in an "L" shape to a space on the chessboard that is colored differently from the space on which the knight has departed.

I have invented a multi-player chess game and method for playing chess with three or more players. Multi-player chess has a playing surface composed of polygonal playing spaces. Each player has an army composed of chessmen that are arrayed on the polygonal playing spaces. Each army has at least one additional chessman that allows unique checkmate targets to be established to maintain an adversarial relationship among the players during a game.

One aspect of the invention allows for multi-player chess using any number (n) of armies. Additional chessmen are added to each army to maintain unique checkmate targets. In a multi-player chess game with (n) number of armies, the number of checkmate targets is equal to the number of armies minus one (n−1).

Another aspect of the invention is a three-army chess game in which chessmen are arranged on alternating sides of the perimeter of a hexagonal multi-player chessboard. Essential geometric correlations and relationships among armies analogous to those of traditional chess are preserved. Alliances between any two of the three armies for the purpose of checkmating the remaining opposing army are eliminated by the inclusion into each army of an additional chessman called a pope. The pope functions as a second checkmate target, providing two unique checkmate targets for each army, thereby obligating each army to effectively checkmate both opposing armies.

Still another aspect of the invention is a two-army chess game in which chessmen are arranged on opposing sides of a rectangular circumscribed area of the hexagonal multi-player chessboard. An additional chessman called a pope functions as a second checkmate target in each army. The inclusion of the pope allows contestants to participate in a two-army chess game which increases skills necessary for use in multi-army chess.

In all aspects of the invention, the armies may be divided into additional armies corresponding to the number of players, allowing a theoretically unlimited number of participants.

DETAILED DESCRIPTION

Historical Basis

Figure 1:
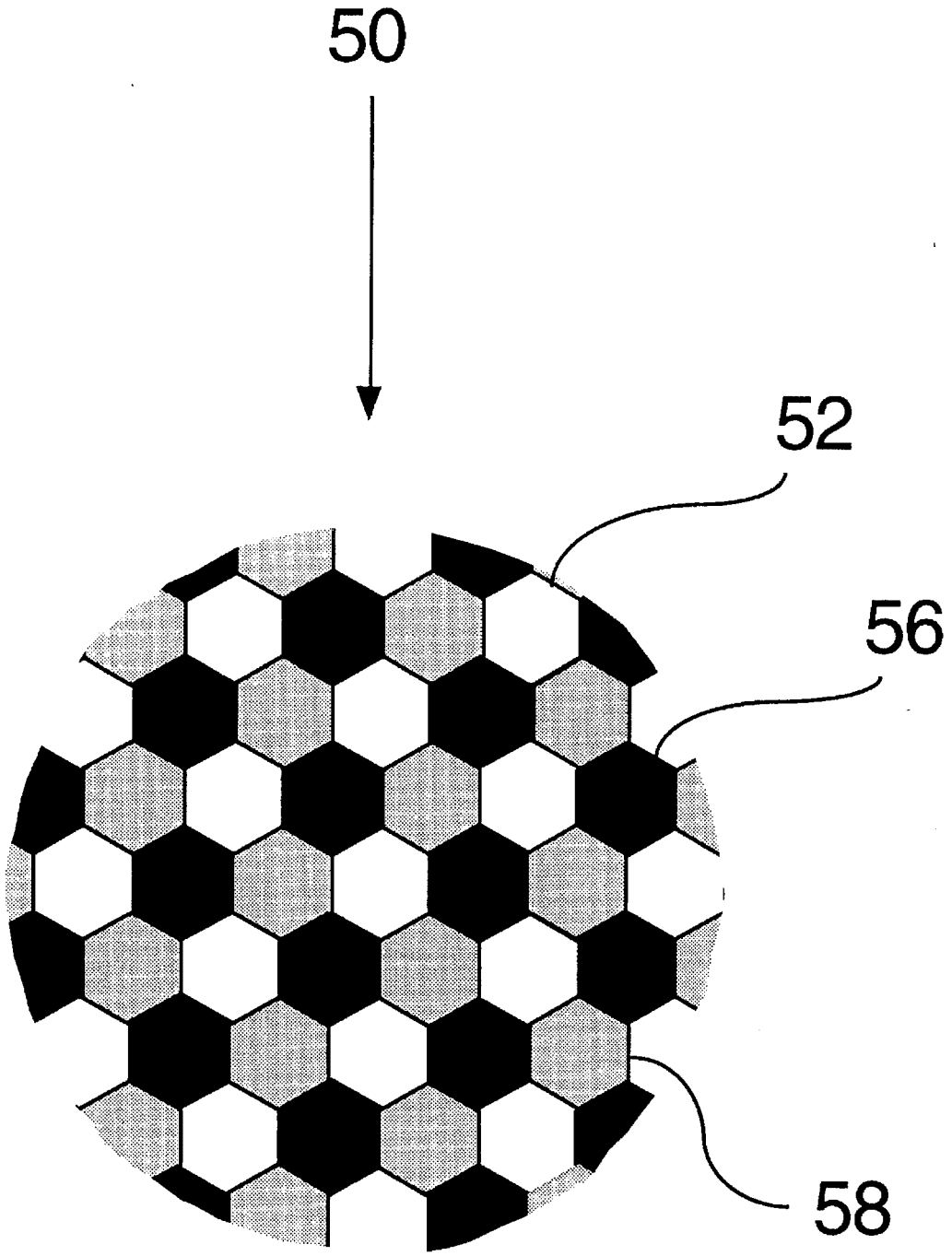
FIG. 1 shows a partial area of a multi-player chessboard.

In medieval Europe there existed an inextricable partnership between Church and State. All temporal authority lay with the Emperor, and all spiritual power with the Pope. As Emperors began to make laws that affected the clergy, a struggle between Papacy and Empire began that lead to the diffusion of the feudal system into territorial nation states where the Emperor could reign supreme.

The steady increase of the Emperor's power during this time was countered by the Popes through attempts to issue laws to reduce the control the Emperor had over the Papacy. One Pope determined to redeem the Papacy, Pope Boniface VIII issued the Papal bull Unam Sanctum, which declared that the institution of kingship was denied by God, and that both temporal and spiritual power lay with the Pope. The result was disastrous. The King of France, Philip, and his lawyers opposed the bull, and fled to Anagni, where the king's henchmen led a brutal assault on the Pontiff. The failing health of Boniface brought him to death shortly thereafter. The following Pope likely found the fate of Boniface unattractive, and did nothing to further the power of the Papacy. The King of France then secured the election of the next Pope, the Archbishop of Bordeaux who took the name of Clement V. Clement was not Roman but French, and he chose to reside in France. This began a 70 year period during which the Papacy resided in Avingnon, France from 1308–1378. In commemoration of the 70 year captivity of the Jews in Babylon, this period has come to be known as the Babylonian captivity of the Papacy. The Popes were not held captive as the name might suggest but stayed in France on their own free will to avoid Rome and the Holy Roman Emperor. The Babylonian captivity ended in 1378 when an Italian Pope, Urban VI was elected to appease the Italian people. Unfortunately Urban showed not only incompetence but signs of insanity. Church law then provided no constitutional means for removing an unsuitable Pope. Hence, the cardinals withdrew from Rome to Anagni, Italy, claiming (under Distinctio 79, canon 9) that the election was invalid due to pressure from the Roman people for a swift process. Urban maintained his ground forcing all of Europe to choose allegiance between two Popes. This disastrous division led to a severe loss of dignity and authority for the Papacy. Successors to the Popes failed to end the conflict, despite numerous councils assembled to do so. The situation worsened until, in the year 1409, each of three Popes, Benedict XIII, Gregory XII and John XXIII, simultaneously claimed to be the true Vicar of Christ. The Papacy had splintered into chaos; hence, the events of this time are referred to as the Great Schism (1378–1417).

Multi-Player Chess in General

Multi-player chess is a modification of traditional chess that is based on the above historical developments. By building on historical developments, it is believed that multi-player chess will be better accepted among traditional chess players than other non-historically based chess variations.

As in traditional chess, each chessman is moved from one space to another according to specific rules. If the chessman is moved to a vacant space, no further action is required. If the chessman is moved to an occupied space, then the opponent's chessman occupying the space is captured and immediately removed from the chessboard by the player making the capture.

Multi-player chess is played using the entire area of a multi-player chessboard, which is composed of a plurality of polygons, whose number of polygonal sides (S), and chessboard sides (B) are equal to or logically correspond to the number of armies (n). These ratios may also correspond to various desired relationships to (n). For example, (S) and (B) may logically correspond to (n–1) or (n+1), allowing three (3) versions of chess {(n–1)-army chess, (n)-army chess, and (n+1)-army chess} to be played on the multi-player chessboard.

Multi-player chess is played with (n) armies of chessmen identical to traditional chessmen with the addition of (n–1) chessmen to each army, which function as checkmate targets on a one to one correspondence with each opposing army. The (n) armies of chessmen are distinguished from one another through the use of a distinguishing feature such as color. The (n–1) additional chessmen in each of the (n) armies are distinguishable from one another through the designation of names and unique physical characteristics, both of which preferably reflect aspects of Medieval history.

The (n–1) additional chessmen achieve a balance of competition by creating unique checkmate targets for each of the (n) armies so that each army must effectively checkmate all opposing armies. Alliances between any number of the (n) armies for the purpose of checkmating any remaining army or armies are thus eliminated, and a balance of competition is maintained, creating an array of objectives whose number of parts is equal to the square of the number of armies $(n)^2$.

The (n) armies rotate making one move at a time. The army with a predetermined color such as white commences the game and play proceeds normally in a clockwise direction.

The movements of each chessman corresponds to the ratios of sides on a chessboard space (S) to possible destinations (D), such that the ratios are equivalent or are logically correlated to those of traditional chess, as well as to (n).

A multi-player chess game is won in any of (n) situations, each of (n–1) situations being a unique ordering of the elements {1,2, . . . (n–1)} where each element corresponds to an opposing army. In other words, (n) situations merely refers to the order in which the opposing armies are conquered, with the additional possibility that all opposing armies may declare their resignation.

Normally, multi-army chess is played by (n) contestants, but by dividing armies into partial armies corresponding to the number of desired participants, (n)-army chess may be played by more than (n) contestants.

Multi-Player Chess

Figure 2A:
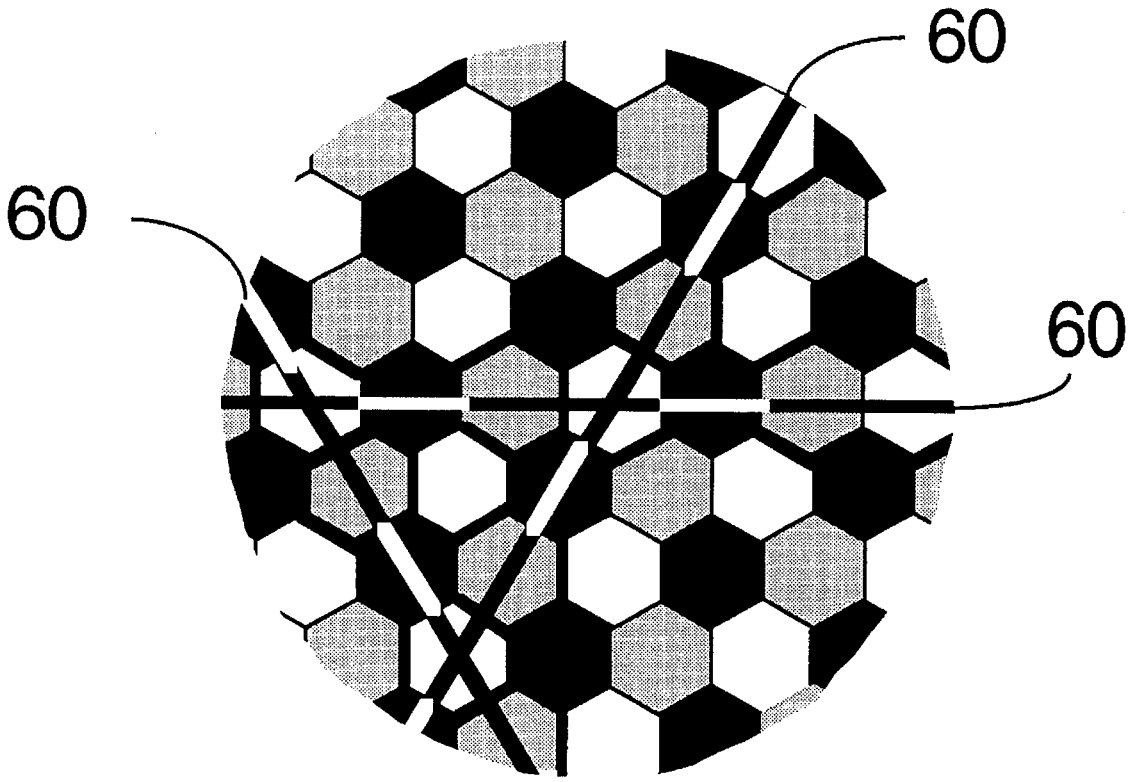
FIG. 2*a–b* shows ranks and files on the multi-player chessboard.
Figure 2B:
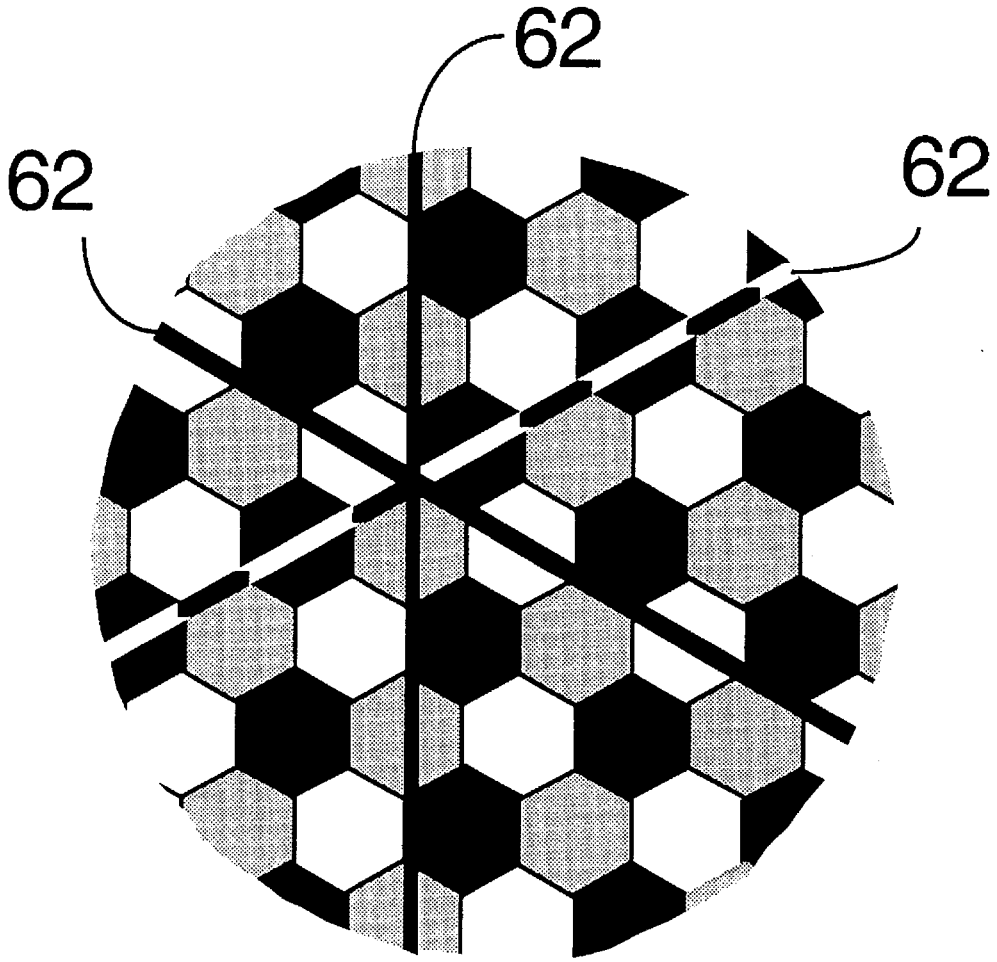

Referring to FIG. 1, a playing surface 50 is shown composed of a plurality of hexagonal spaces 52. The hexagonal spaces 52 are patterned sequentially with one of three alternating patterns, preferably white 54, black 56, and gray 58. Referring to FIG. 2*a*, a rank 60 is a straight line of adjacent hexagonal spaces 52 spanning the playing surface 50. Each hexagonal space 52 on the playing surface is thus included in three ranks 60. Referring to FIG. 2*b*, a file 62 is a straight line of non-adjacent hexagonal spaces 52 of the same pattern spanning the playing surface 50. Each hexagonal space 52 on the playing surface 50 thus is included in three files 62.

Figure 3:
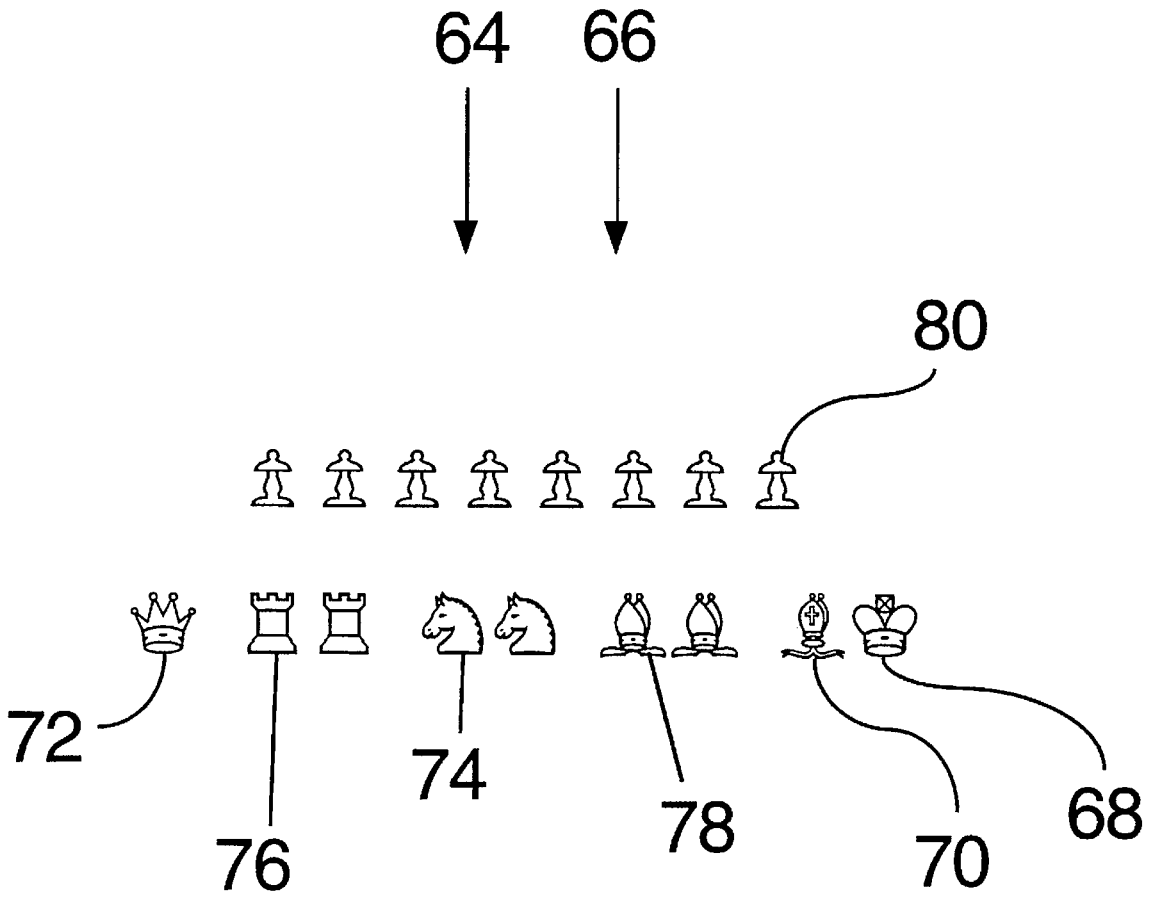
FIG. 3 shows multi-player chessmen.
Figure 4:
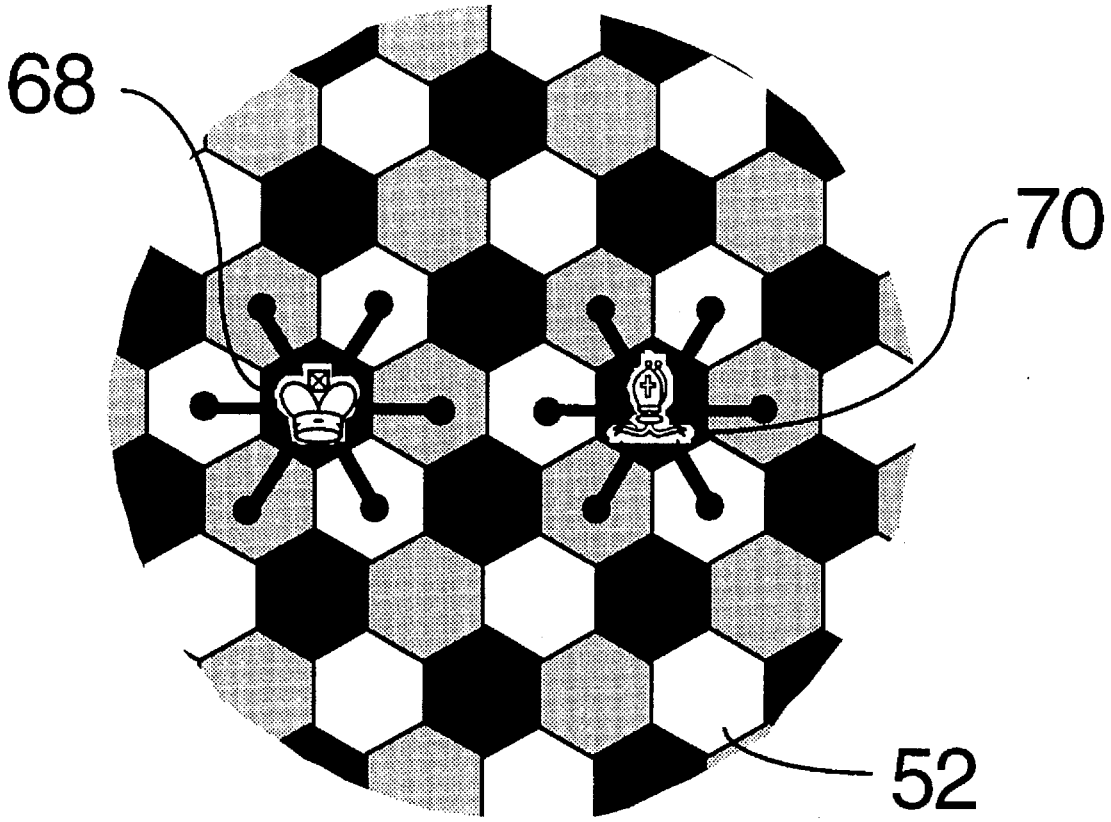
FIG. 4 shows king and pope movements on the multi-player chessboard.

Referring to FIGS. 3 and 4, an army 64 of multi-player chessmen 66 is shown. An army is defined as a group of multi-player chessmen 66 which includes at least one principal element 69; i.e. a king 68 or a pope 70. Each element of an army 64 of multi-player chessmen 66 is referred to as a chessman. Multi-player chess is played with at least two armies 64 of chessmen, in which each army 64 is comprised of a king 68, and at least one additional chessman preferably known as a pope 70, knights 72, a queen 74, rooks 76, bishops 78, and pawns 80. The historical basis for the inclusion into each army 64 of a pope 70 is the simultaneous existence of several Popes in the period of 14th Century history known as the Great Schism, in which first two and then three Popes claimed the right to the Papacy.

Referring to FIG. 4, the pope 70 moves identically to the king 68; i.e., the pope 70 can move to any adjacent hexagonal space 52 that is not occupied by one of his own chessmen 66 (FIG. 3) or threatened by an opposing chessman 66 (FIG. 3). The pope 70 not only shares power with the king 68, but is also the focus of the principal objective of the game in the same manner as a king 68, namely the checkmate. The pope 70 and king 68 are thus referred to as principal elements 69 which must be "neutralized" through the acts of check and checkmate. To reflect the convictions put forth by Pope Boniface VIII in the Papal bull Unam Sanctum, the additional chessman representing the Pope should stand taller than the king 68, although the chessman may take some other form.

Figure 5:
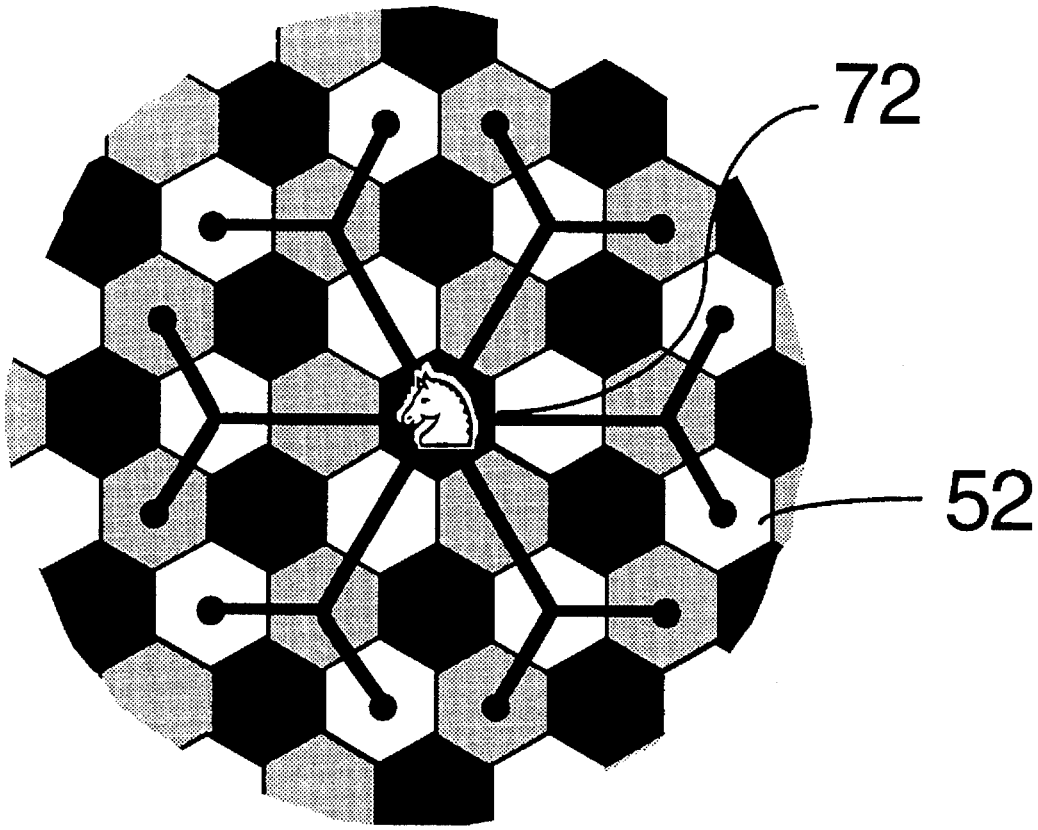
FIG. 5 shows knight movements on the multi-player chessboard.

Referring to FIG. 5, as in traditional chess, the knight 72 is the only piece which may jump over any other chessman, and the knight's 72 movement is in an "L" shape, composed of two steps. First, the knight 72 moves along a straight line of two adjacent hexagonal spaces 52, and, second, still moving away from the hexagonal space 52 of departure, the knight 72 moves one adjacent hexagonal space 52 to either side. When centrally positioned, the knight 72 has twelve possible destinations, all of which allow the knight 72 to move to a hexagonal space 52 of a different pattern from the hexagonal space 52 the knight 72 departed from. Thus, the ratio of possible directions of movement (D) of the knight 72 to hexagonal space 52 sides (S) is equal to the same ratio in traditional chess, as shown in the following table:

| | Traditional Chess | Three-Army Chess | Multi-Player Chess in general |
|---|---|---|---|
| D(knight) | 8 | 12 | 4n |
| S | 4 | 6 | 2n |
| D/S | =2 | =2 | =2 |

Figure 6:
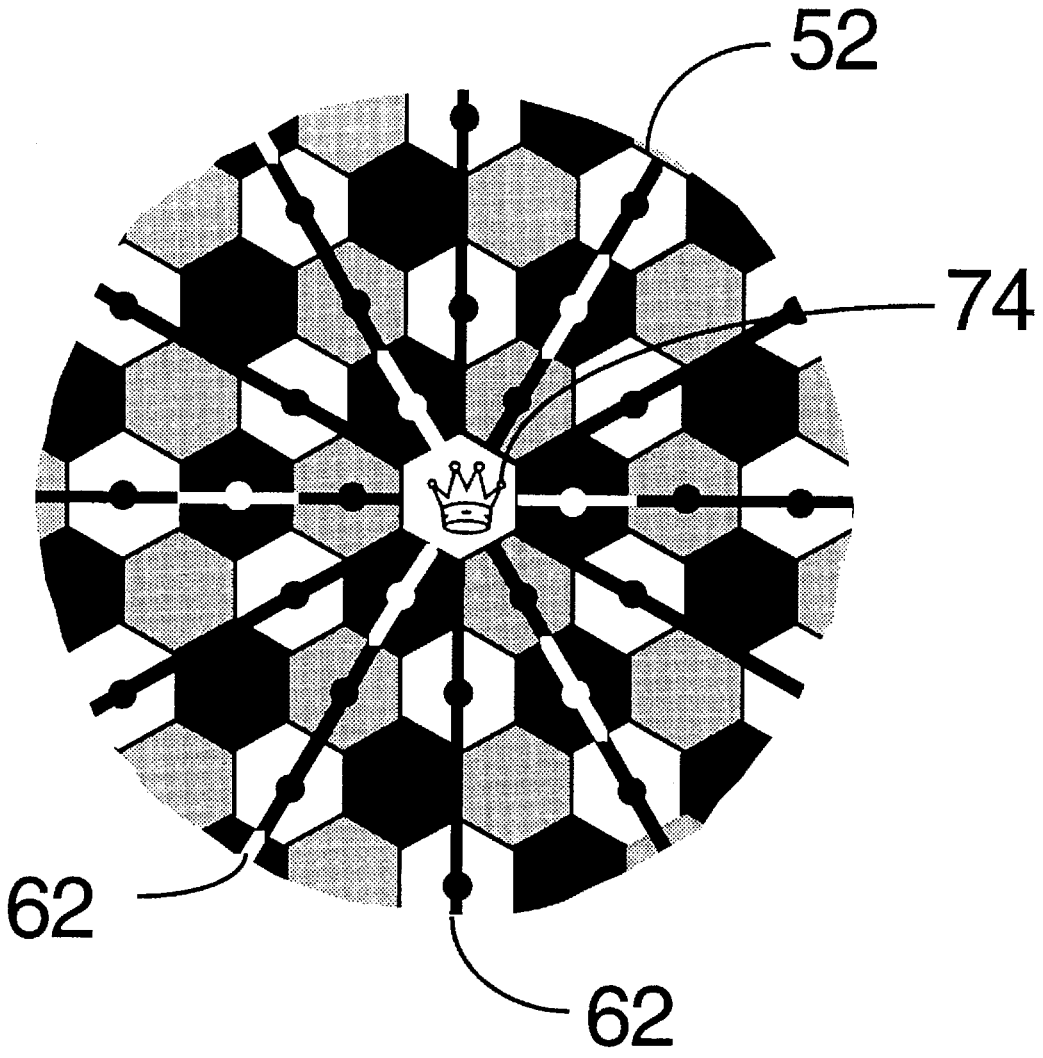
FIG. 6 shows queen movements on the multi-player chessboard.

Referring to FIG. 6, the queen 74 can move to any unobstructed hexagonal space 52 along any one of twelve possible directions of movement. More specifically, the queen 74 can move any number of hexagonal spaces 52 so far as it is unobstructed along any of the three ranks 60 on which it stands, or any number of hexagonal spaces 52 so far as it is unobstructed along any of the three files 62 on which it stands. Thus the ratio of possible directions of movement (D) of the queen 74 to hexagonal space 52 sides (S) is equal to the same ratio in traditional chess, as shown in the following table:

| | Traditional Chess | Three-Army Chess | Multi-Player Chess in general |
|---|---|---|---|
| D(queen) | 8 | 12 | 4n |
| S | 4 | 6 | 2n |
| D/S | =2 | =2 | =2 |

Figure 7:
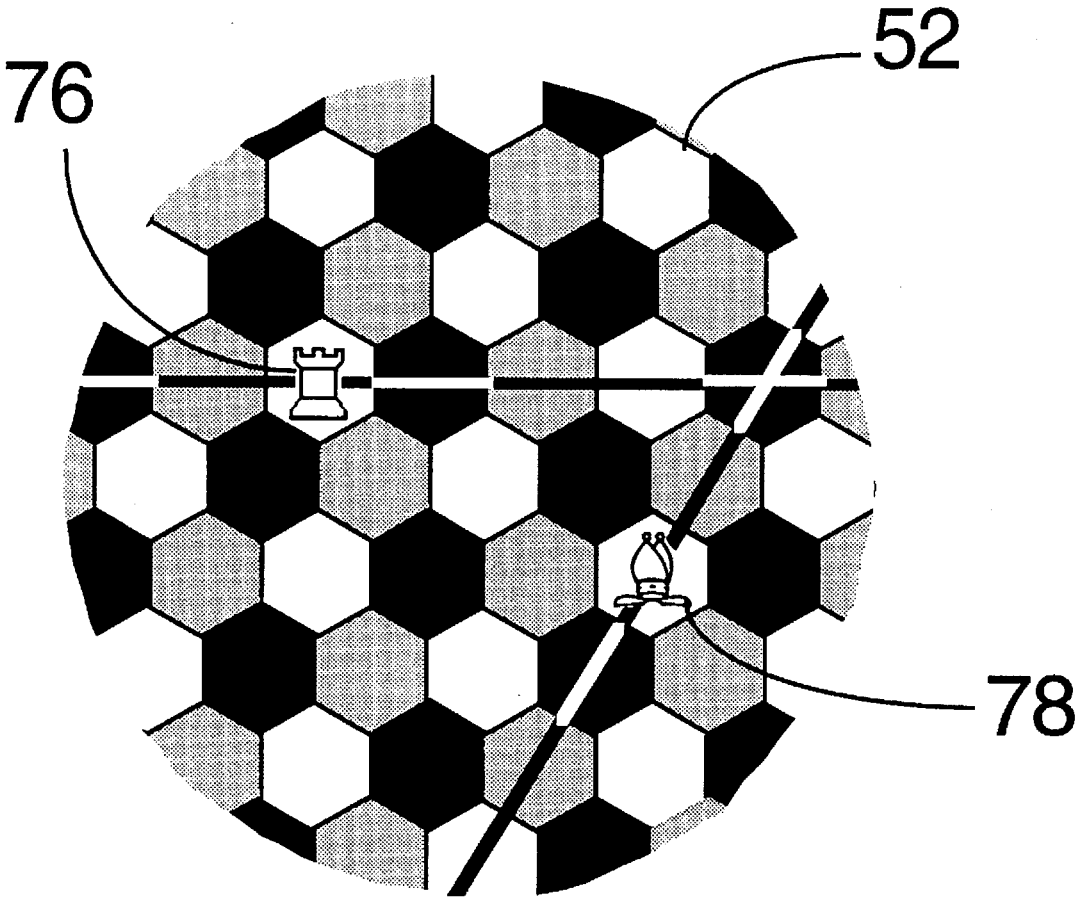
FIG. 7 shows rook and bishop movements on the multi-player chessboard.
Figure 8A:
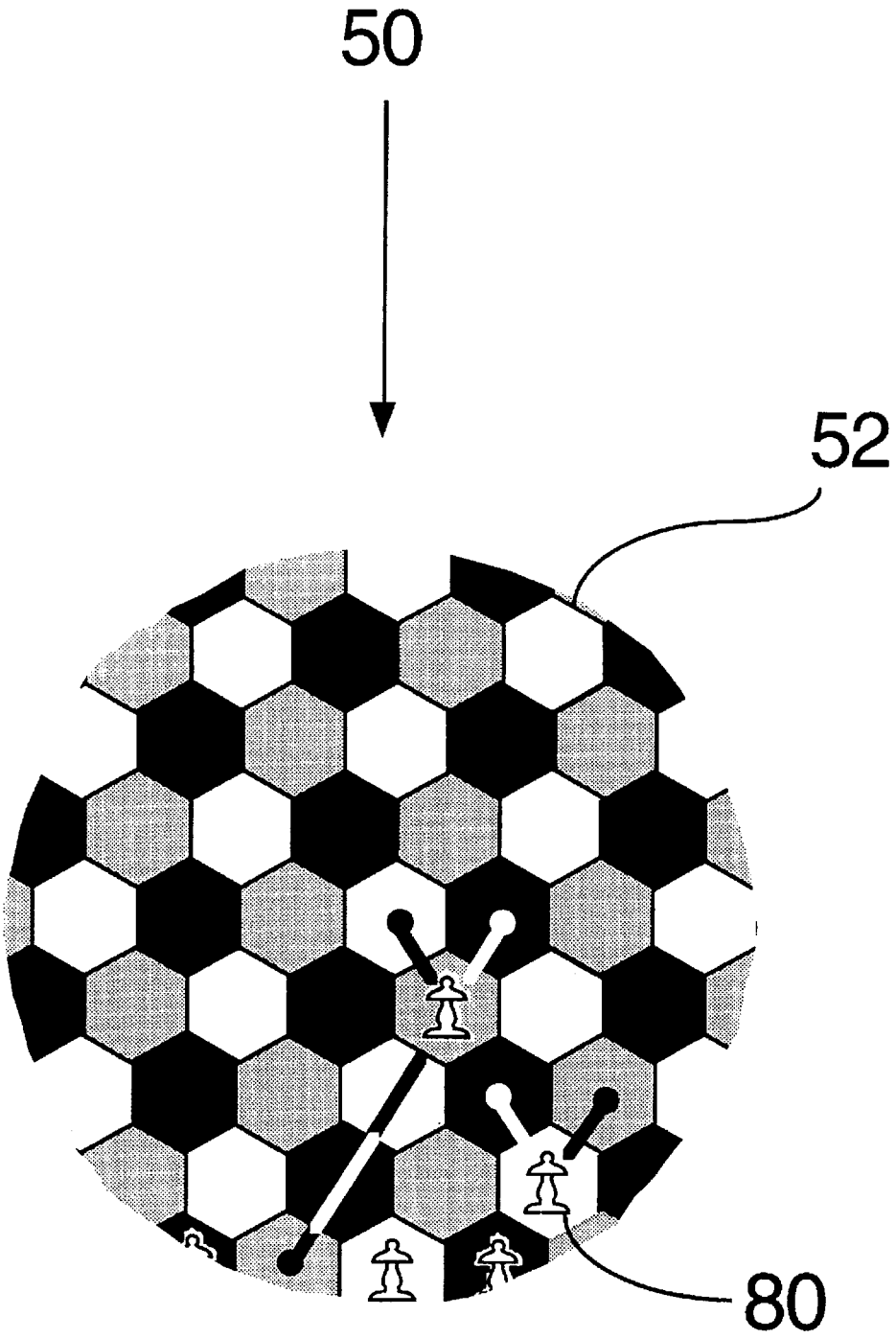
FIG. 8*a* shows non-capturing pawn movements on the multi-player chessboard.
Figure 8B:
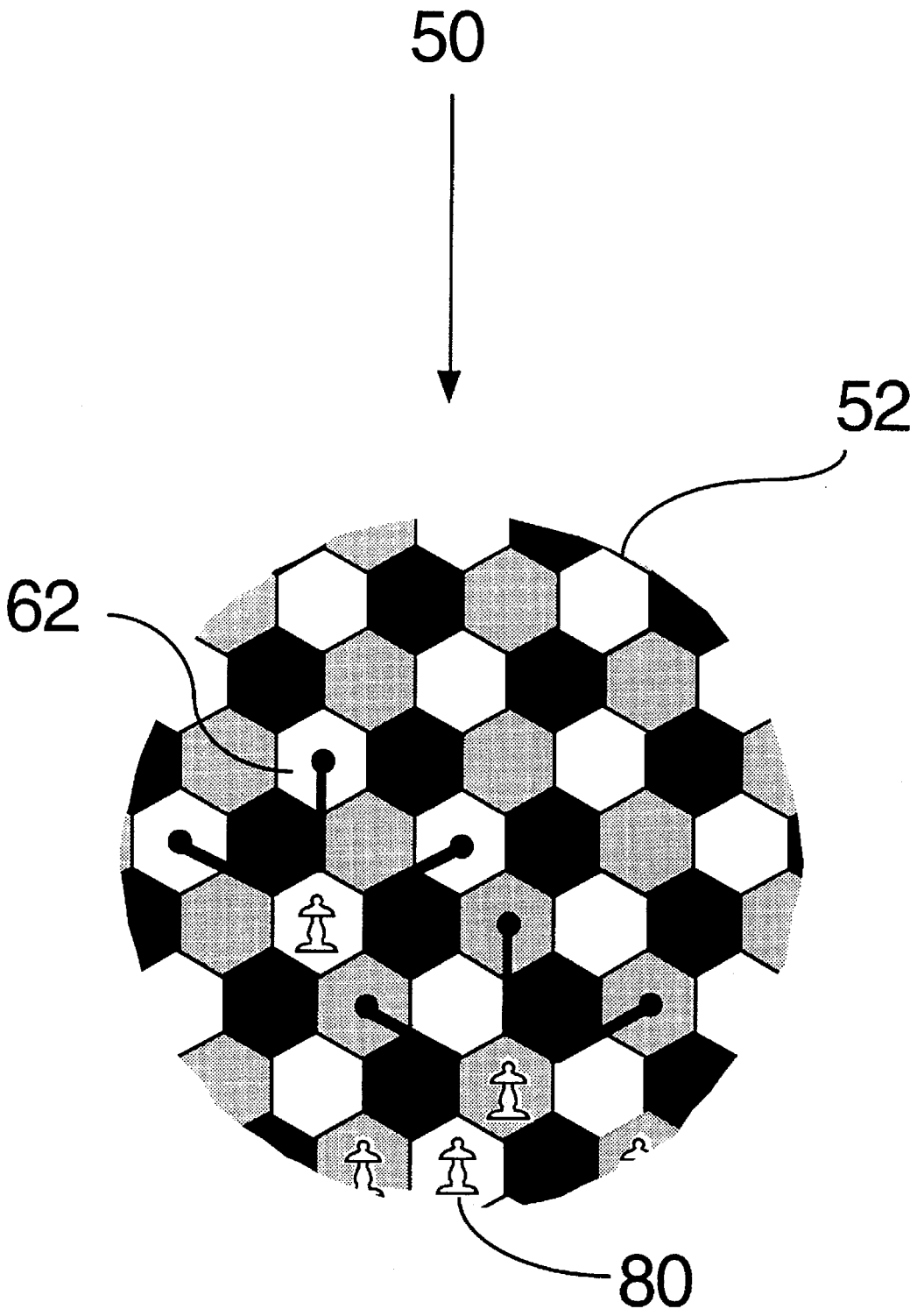
FIG. 8*b* shows capturing pawn movements identified on the multi-player chessboard.

Referring to FIG. 7, a rook 76 and a bishop 78 move any number of hexagonal spaces 52 along ranks 60. Rooks 76 and bishops 78 thus maintain the ratio of possible directions of movement (D) to hexagonal space 52 sides (S) which is equal to the alalogous ratios in traditional chess, as shown in the following table.

| | Traditional Chess | Three-army Chess | Multi-Player Chess in general |
|---|---|---|---|
| D(rook/bishop) | 4 | 6 | 2n |
| S | 4 | 6 | 2n |
| D/S | =1 | =1 | =1 |

Referring to FIGS. 8*a–b*, 2*a–b*, and 3, pawn 80 movement is as follows. As in traditional chess, a pawn 80 may only move forward, forward movement being defined as movement toward an opposing army 64. In multi-player chess, the possible directions of forward movement is equal to the number of opposing armies 64. For example, in a four-army game, forward movement consists of three possible directions of movement. In multi-player chess, each pawn 80 may move forward up to a number of hexagonal spaces 52 equal to the number of armies 64 on the playing surface 50 on its initial move. For example, in a three-army game, a pawn 80 may move up to three hexagonal spaces 52 forward on its initial move. Thereafter, a pawn 80 is only permitted to move forward one hexagonal space 52 at a time. As in traditional chess, the pawn 80 does not capture in the forward direction, and the number of possible directions for capturing movement is equal to the number of armies 64 on playing surface 50. For example, in a three-army game, the pawn 80 captures in three forward directions along the three files 62 on which it stands. As shown in the following table, the relationships between armies 64 (n), non-capturing pawn 80 destinations (D), and capturing pawn 80 destinations (C), are equal to those of traditional chess.

| | Traditional Chess | Three-Army Chess | Multi-Player Chess in general |
|---|---|---|---|
| n | 2 | 3 | n |
| D(pawn) | 1 | 2 | n − 1 |
| C | 2 | 3 | n |

As in traditional chess, pawns 80 are promoted by reaching a specified rank 60 on the opposite side of the playing surface 50. When a pawn 80 reaches the specified rank 60, the pawn 80 is immediately exchanged for either a knight 72, a queen 74, a rook 76, or a bishop 78 of the same color. The process described above of exchanging a pawn 80 for a knight 72, queen 74, rook 76, or bishop 78 of the same color is referred to as "pawn promotion".

Figure 9:
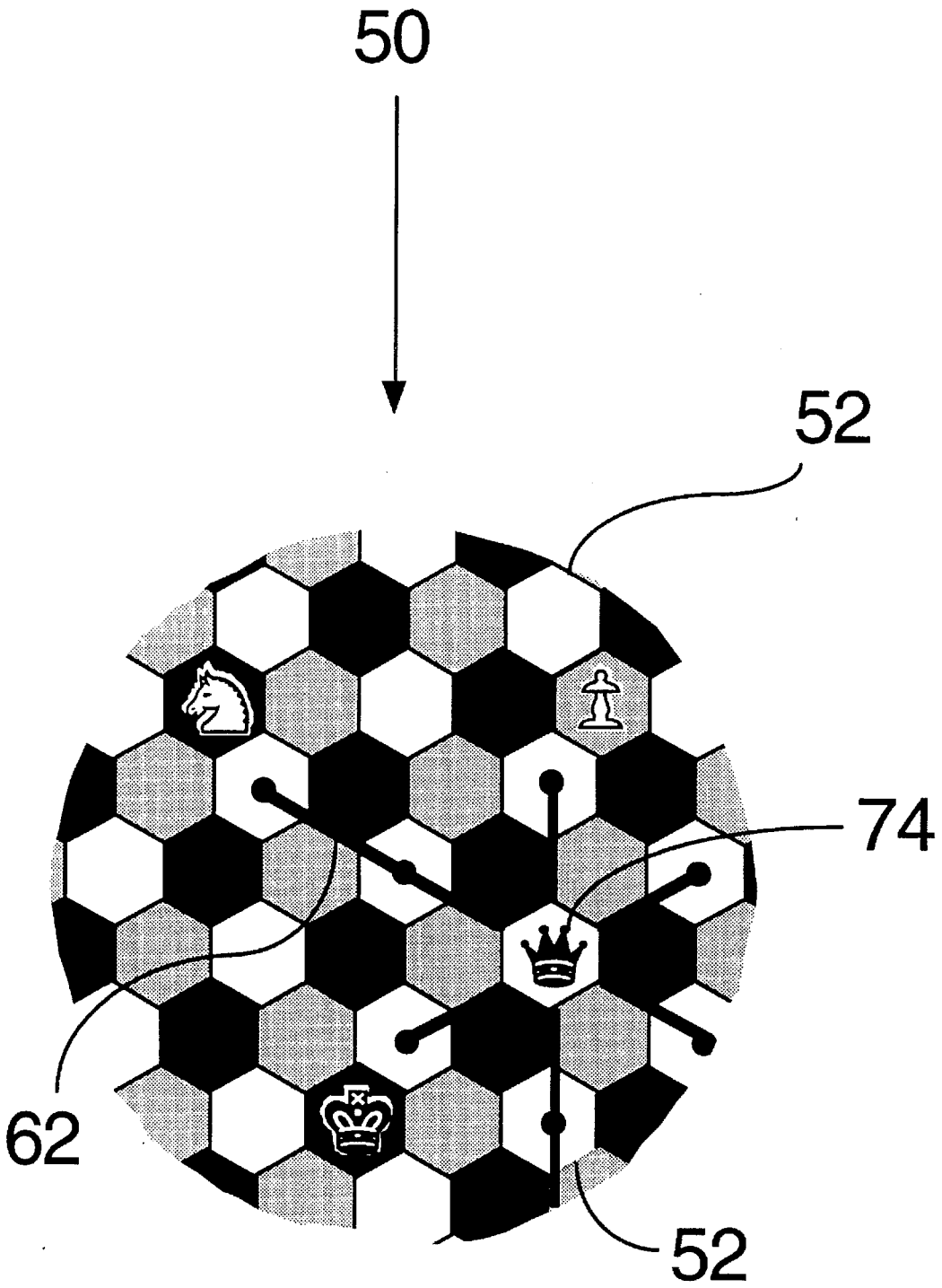
FIG. 9 shows file blocking on the multi-player chessboard.

Referring to FIG. 9, "file blocking" defines constrictions on movement of multi-player chessmen 64 moving on files 62 imposed by other multi-player chessmen 64 occupying hexagonal spaces 52 adjacent to two hexagonal spaces 52 of a file 62.

In multi-player chess, the traditional chess term "check" refers to the threatening of either a king 68 or a pope 70 by an opposing army's 64 chessman. Contrary to traditional chess, in multi-player chess, check does not entail the end of a game. In multi-player chess, the number of checks is equal to the number of opposing armies 64, the final numbered check entailing the end of a game. The final numbered check is referred to as "final check". For example, in four-army chess, the terms "check", and "second check", and "third check" are used, third check being the final check entailing the end of a game. When threatened, the principal element 69 is said to be "in check" or "in (number) check", by the opposing army 64 checking the principal element 69. The player checking an opposing army's 64 king 68 or pope 70 announces "check" upon the act of doing so. When the player checking has already captured an opposing army's 64 principal element 69, the player checking announces "second check" upon the act of checking. There are several varieties of check, corresponding to the priciple element 69 being checked, i.e. when the king 68 is in check, it is refereed to as "king's check", when the pope 70 is in check, it is refereed to as "pope's check", etc. "Double check" occurs when any two kings 68, any two popes 70, or both a king 68 and a pope 70 are simultaneously in check. In four-army chess, a "triple check" may occur. In (n)-army chess, a "(n–1) check" may occur.

Because check does not entail the end of a game, check need not be immediately parried. Check may thus result in the neutralization and loss of the priciple element 69 being checked, i.e. a king 68 or pope 70. Conversely, final check entails the end of a game, and must be immediately parried by the player in check upon his next move. A parry consists of either eliminating the check by capturing the enemy chessman currently checking, moving the checked principal element 69 to an unattacked adjacent hexagonal space 52 or blocking the check with another chessman. If final check cannot be parried, the principal element is neutralized, and the situation is referred to as "checkmate", and the game ends.

A game is a draw in any of the three following situations. A draw results when either the king 68 or pope 70 of the player whose turn it is to move is not in check and such player cannot make any legal move. The king 68 or pope 70 is then said to be "stalemated", and the game is a draw. A draw can also result when both players agree that the game should be called a draw. Finally a draw can result upon the demand of one of the players when the same or similar position has appeared a number of times on the same player's move. Before a game is started the players should reach an agreement on the number of repetitions of a similar position will result in a draw.

Three-Army Chess

Figure 10:
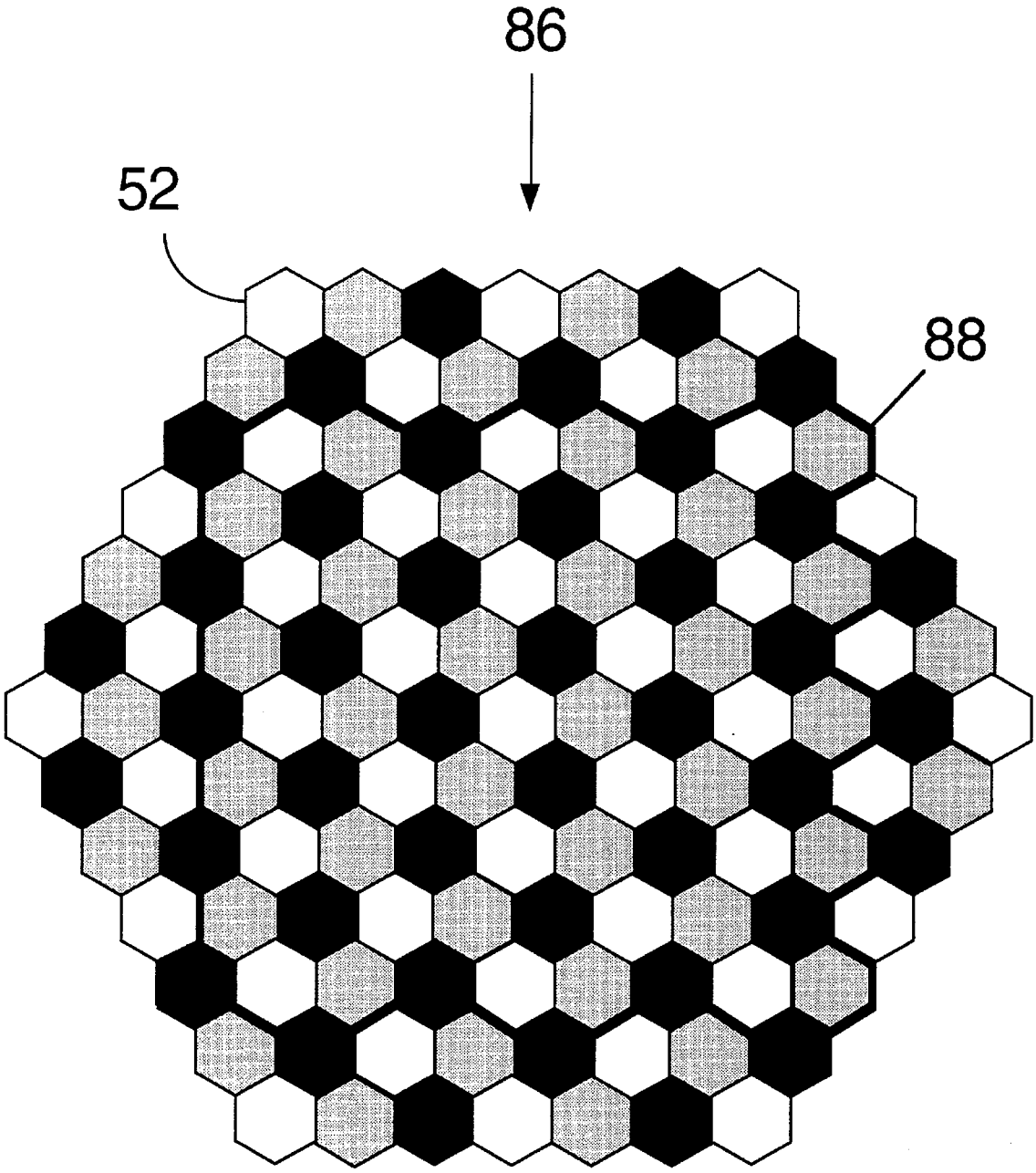
FIG. 10 shows a multi-player chessboard.

Referring to FIG. 10, the multi-player chessboard 86 is composed of one hundred twenty-seven equilateral hexagonal spaces 52 that are arranged to form a large hexagon with seven individual hexagonal spaces 52 on each side of the multi-player chessboard 86. The multi-player chessboard 86 has a rectangular circumscribed area 88 encompassing seventy-seven hexagonal spaces 52.

Figure 11:
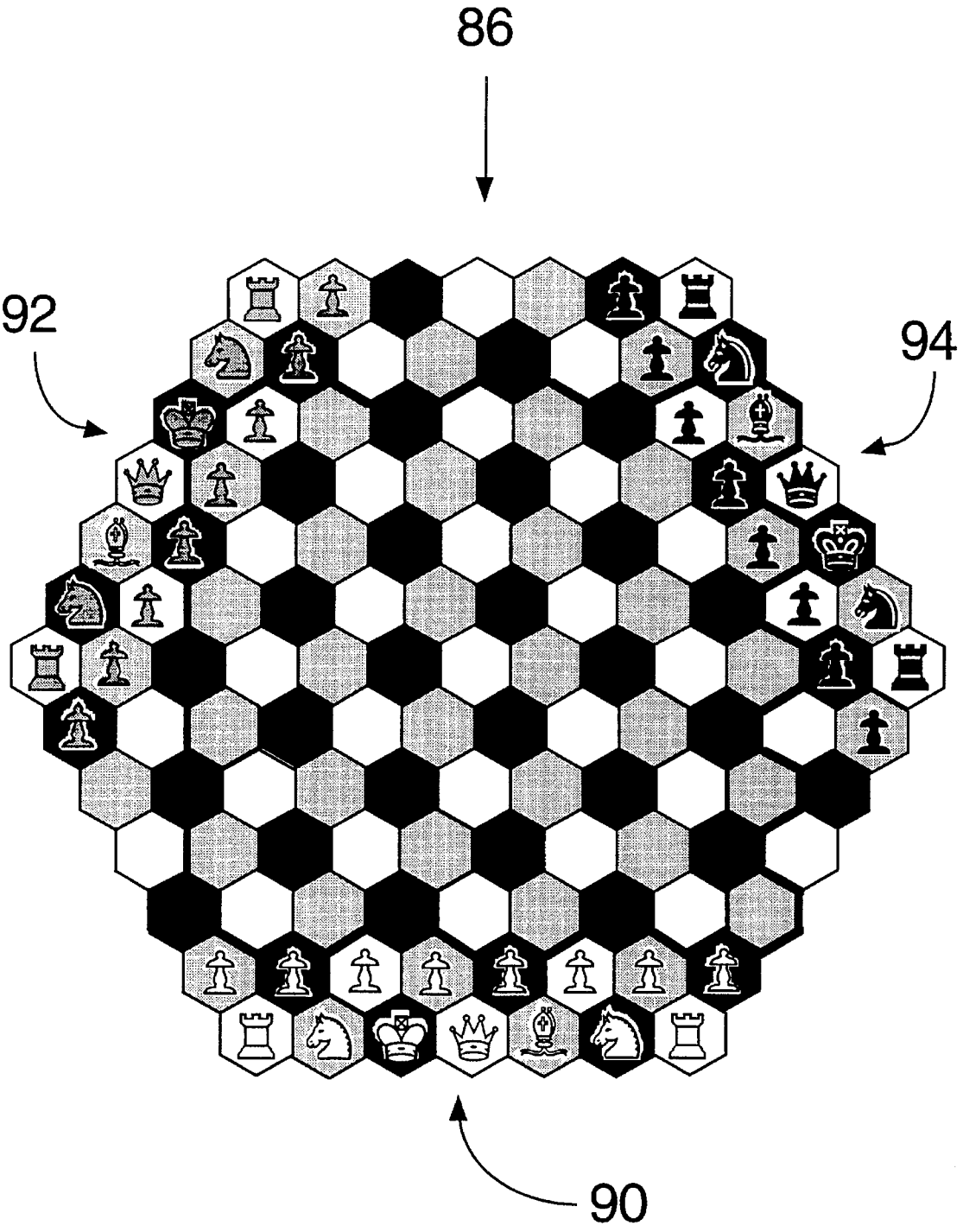
FIG. 11 shows three armies of chessmen in an initial array on the multi-player chessboard.

Three-army chess is played using the entire area of the multi-player chessboard 86. Referring to FIG. 11, initial placement of three armies 90,92,94, consisting of multi-player chessmen 66 on the multi-player chessboard 86 is shown.

Figure 12:
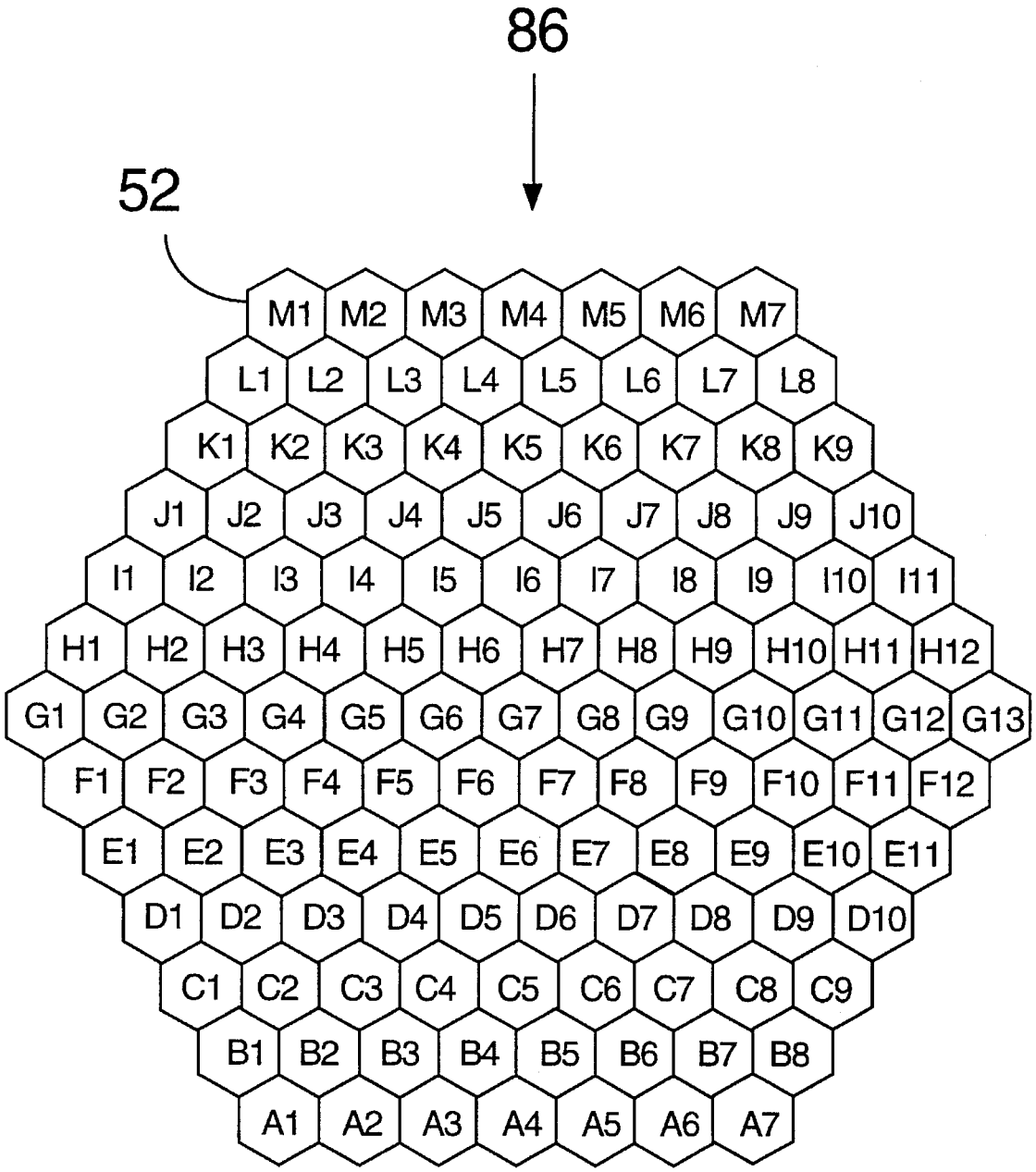
FIG. 12 shows the multi-player chessboard with playing spaces labeled.

Referring to FIG. 12, the hexagonal spaces 52 on the multi-player chessboard 86 are algebraically labeled with a letter and a number for notational purposes. Letters begin with the first rank 60 on the white army's 90 side, rank 60 "A", through the last rank 60 from the white army's 90 side, rank 60 "M". Numbers begin with "1" from the white army's 90 leftmost hexagonal space 52 and advance in sequence each hexagonal space 52 to the right of the white army 90.

Ranks 60 are identified by numbers one through thirteen counted from each army with the first rank 60 being immediately in front of each army 90. The row of adjacent hexagonal spaces 52 spanning the multi-player chessboard 86 from (C1–M5) is a rank 60 and (D1–D10) is a rank 60. The row of identically patterned non-adjacent hexagonal spaces 52 spanning the multi-player chessboard 86 from (A1–M1) is a file 62, and (G1–A7) is a file 62.

Figure 13:
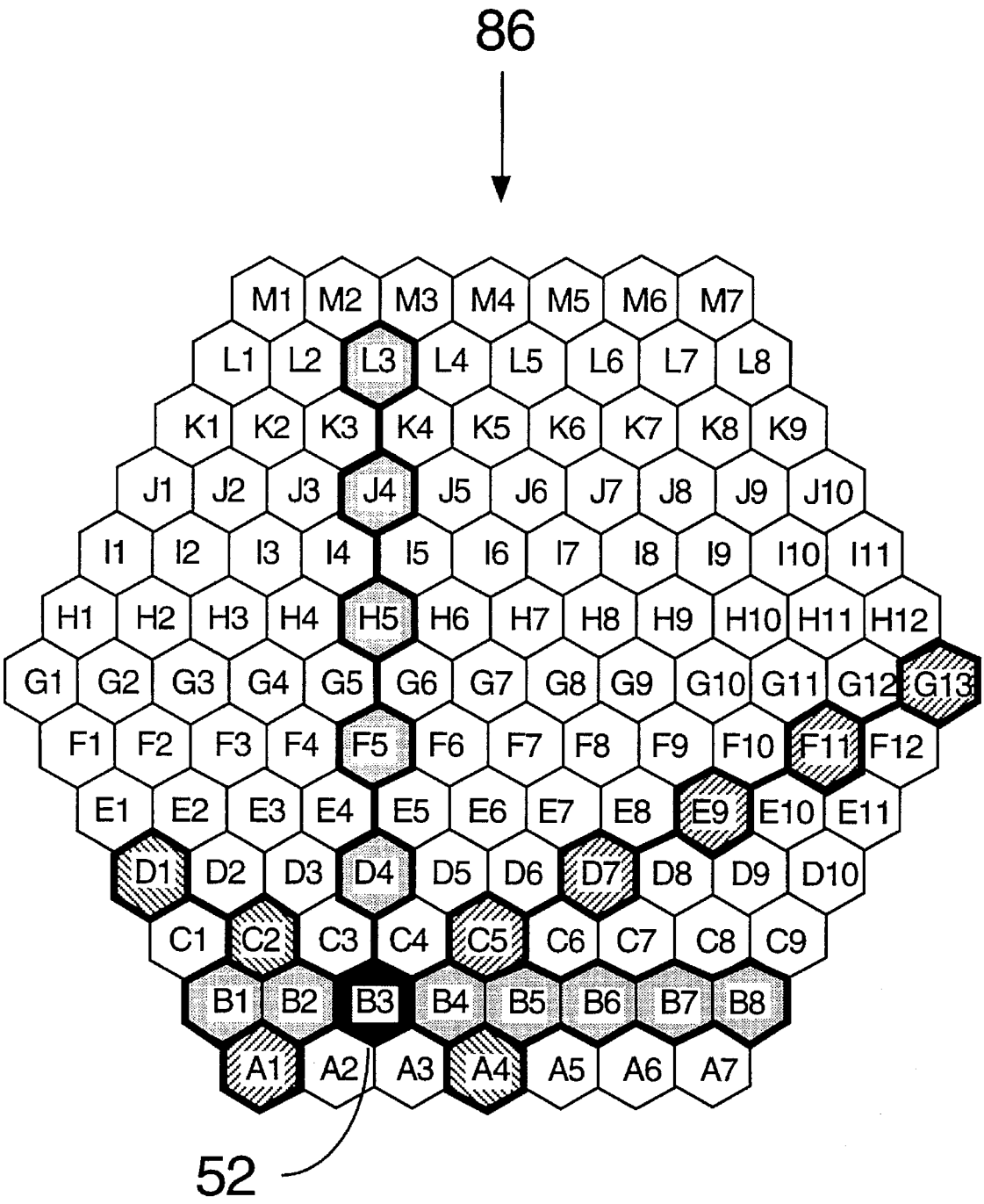
FIG. 13 shows the spatial identify of a single space on the multi-player chessboard.

Referring to FIG. 13, the spatial relationship of one hexagonal space 52, B3, to each army 90, ranks 60 and files 62 is as follows. Hexagonal space 52 (B3) is included in white's second rank 60, gray's third rank 60, and black's eleventh rank 60. Hexagonal space 52 (B3)is included in the files 62 (D1–A4), (B3–L3), and (A1–G13).

Three-army chess is played with three armies 90 of chessmen identical to traditional chessmen with the exception that bishops 78 do not begin as active chessmen, and a chessman referred to as a pope 70 is added to each army. Each army 90 is distinguished from other armies 90 through the use of a distinguishing feature such as color. As an example the first army 90 may be white, the second army 92 black and the third army 94 gray.

Figure 14:
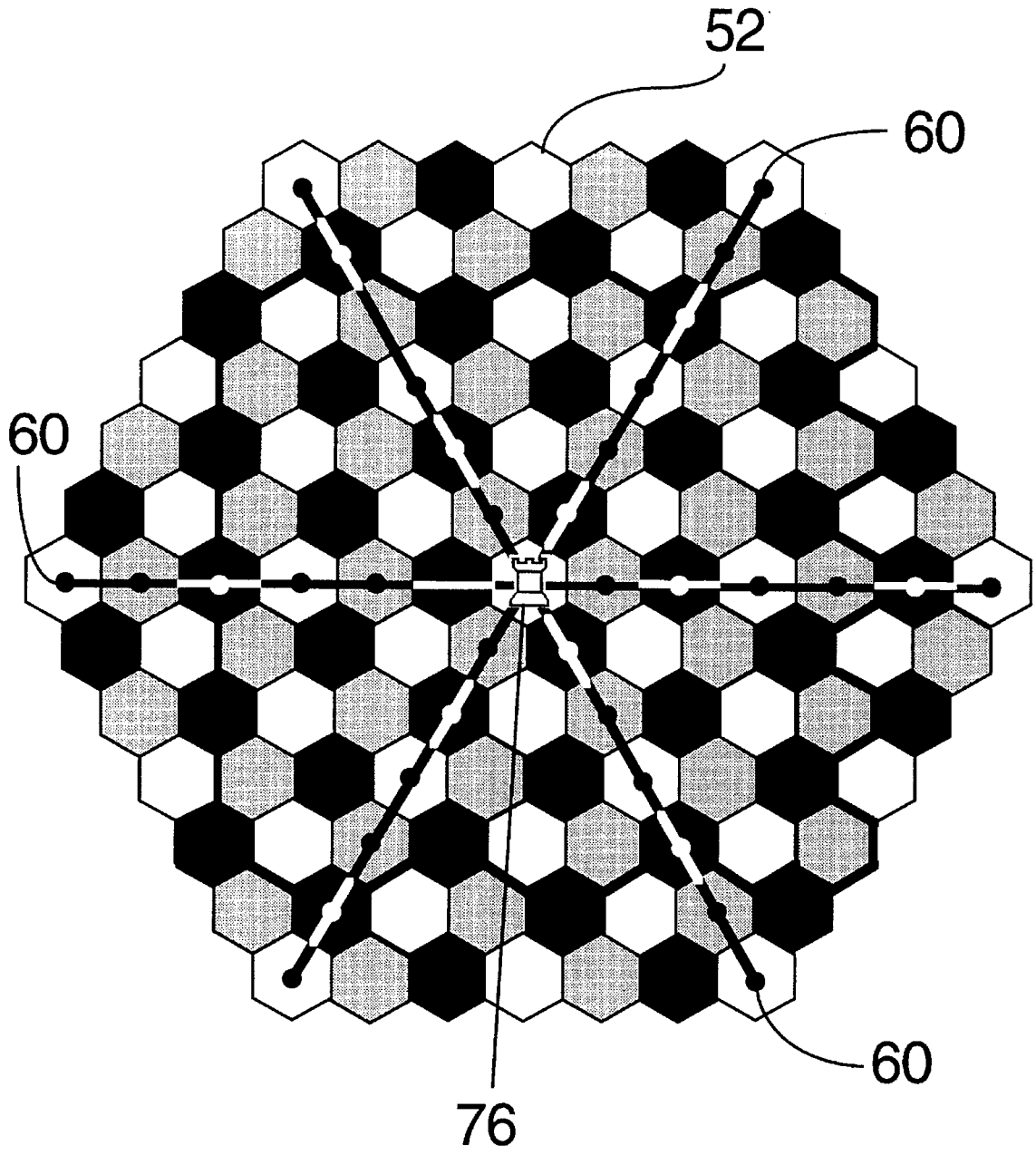
FIG. 14 shows three-army rook movements identified on the multi-player chessboard.

Referring to FIG. 14, a three-army rook 76 can move to any unobstructed hexagonal space 52 along any one of six possible directions of movement. More specifically, the three-army rook 76 can move on any of the three ranks 60 on which it stands.

Figure 15:
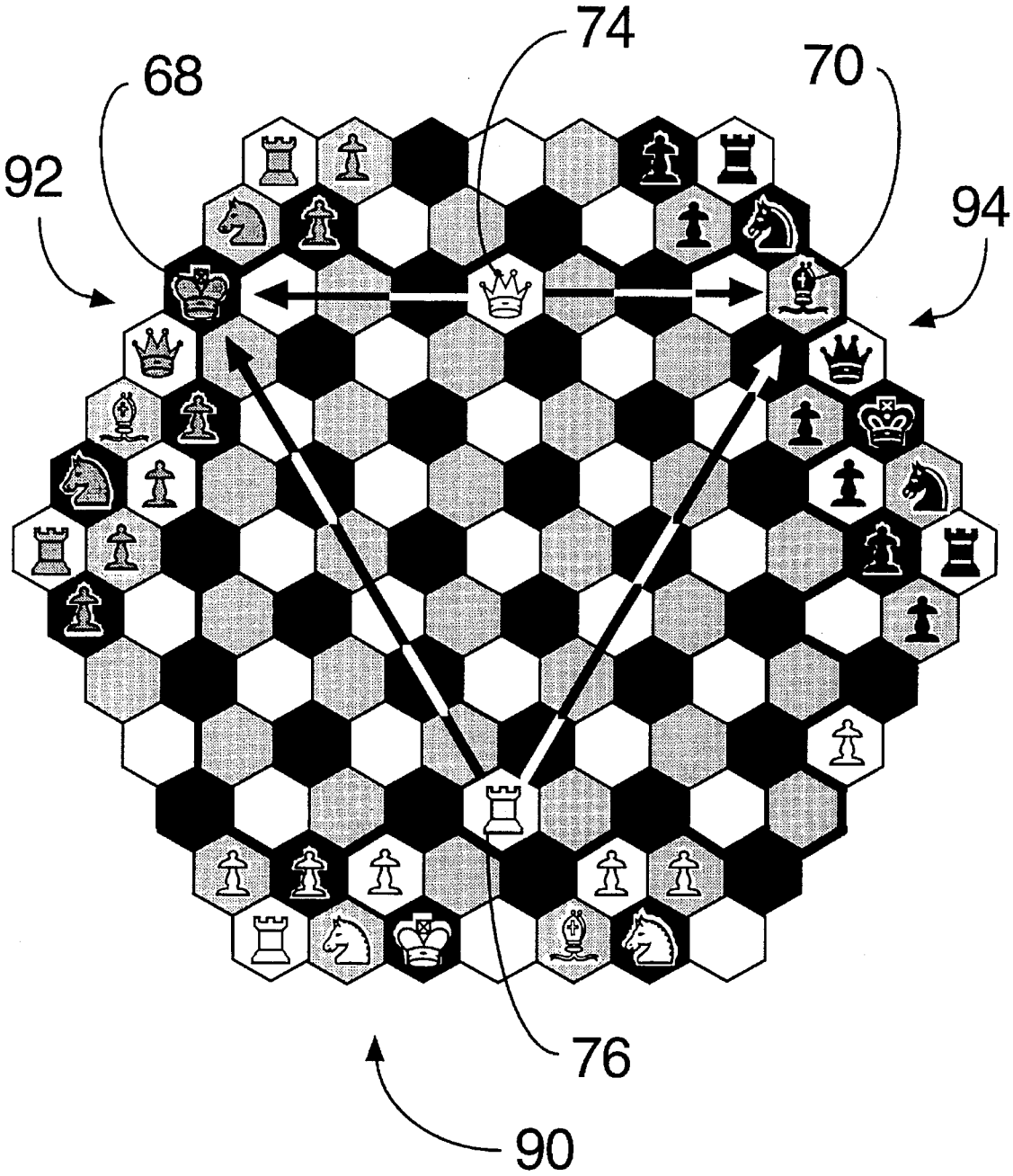
FIG. 15 shows a three-army double check on the multi-player chessboard.

Referring to FIG. 15, an example of a three-army double check is shown. The white army 90 uses his queen 74 and rook 76 to check both the gray army's 90 king 68 and the black army's 90 pope 70 simultaneously.

In three-army chess, the relationship of hexagonal space 52 sides to number of armies 90, multi-player chessboard 86 sides to number of armies 90, and hexagonal space 52 patterns to number of armies 90 is equivalent to the analogous relationships in traditional chess. The relationship between the number of sides on the multi-player chessboard 86 (B); the number of sides on a hexagonal space 52 (S); the number of patterns on the multi-player chessboard 86 (C); and, the number of armies 90 (n) can be expressed as follows:

$$\frac{S}{n}=\frac{6}{3}=2 \quad \frac{B}{n}=\frac{6}{3}=2$$

$$\frac{\frac{S}{n}}{\frac{B}{n}}=\frac{6}{6}=1 \quad \frac{C}{n}=\frac{3}{3}=1$$

The final result of the above relationship comparison is equal to one or unity. These relationships correspond to the analogous relationships in traditional chess as can be seen below:

$$\frac{S}{n}=\frac{4}{2}=2 \quad \frac{B}{n}=\frac{4}{2}=2$$

$$\frac{\frac{S}{n}}{\frac{B}{n}}=\frac{2}{2}=1 \quad \frac{C}{n}=\frac{2}{2}=1$$

The addition of the pope 70 achieves a balance of competition by creating unique checkmate targets for each army 90 so that each army 90 must effectively checkmate both opposing armies 90. Alliances between any two of the three armies 90 for the purpose of checkmating the remaining army 90 are thus eliminated, and the crucial element of checkmate is retained in its original finality. As discussed earlier, addition of the pope 70 has its historical basis in the alliance of the church and state, and the existence of several popes 70 has its historical basis in the period of 14th Century history known as the Great Schism, when each of three Popes claimed the right to the Papacy.

The three armies 90 rotate making one move at a time. The army 90 with a predetermined color such as white commences the game and play proceeds normally in a clockwise direction. An army 90 wins the contest when the army 90 captures the pope 70 of the opposing army 90 to the left and the king 68 of the opposing army 90 to the right, in no particular order. For instance, if army (A) 90 captures the pope 70 of army (B) 92, and army (C) 94 captures the king 68 of army (B) 92, the game does not end, since no army 90 has defeated both opposing armies 92,94. Furthermore, in the above situation, army (B) 92 not only remains in the game, but may win the game even with the loss of a king 68 and pope 70. If each army (A, B, and C) 90,92,94 must conquer both a king 68 and a pope 70, the result is the table below:

| | Objective |
|---|---|
| Army A | Army B's King & Army C's Pope |
| Army B | Army C's King & Army A's Pope |
| Army C | Army A's King & Army B's Pope |

As stated earlier, there is a balance of competition because each army 90 has two unique targets. Furthermore, the number of parts in the above table, nine, is equal to the square of the number of armies 90, ($3^2$).

A three-army chess game is won in any of the three following situations. First, a game is won when an army 90 checks and captures the pope 70 of the opposing army 92 to his right and second checks and checkmates the king 68 of the opposing army 94 to his left. Second, a game is won when an army 90 first checks and captures the king 68 of the opposing army 94 to his left and then checks and checkmates the pope 70 of the opposing army 92 to his right. Finally, a game is won if both opposing armies 92, 94 resign from a game. Each army 90 may choose to neutralize the king 68 of the opposing army 92 to his right only if the army 90 checking still possesses a pope 70; however, such an action is of no advantage, as it serves only to benefit the opposing army 94 to the left. An army 90 may choose to neutralize the pope 70 of the opposing army 94 to his left only if the army 90 checking still possesses a king 68; however, such an action is of no advantage, as it serves only to benefit the opposing army 92 to the right.

Figure 16A:
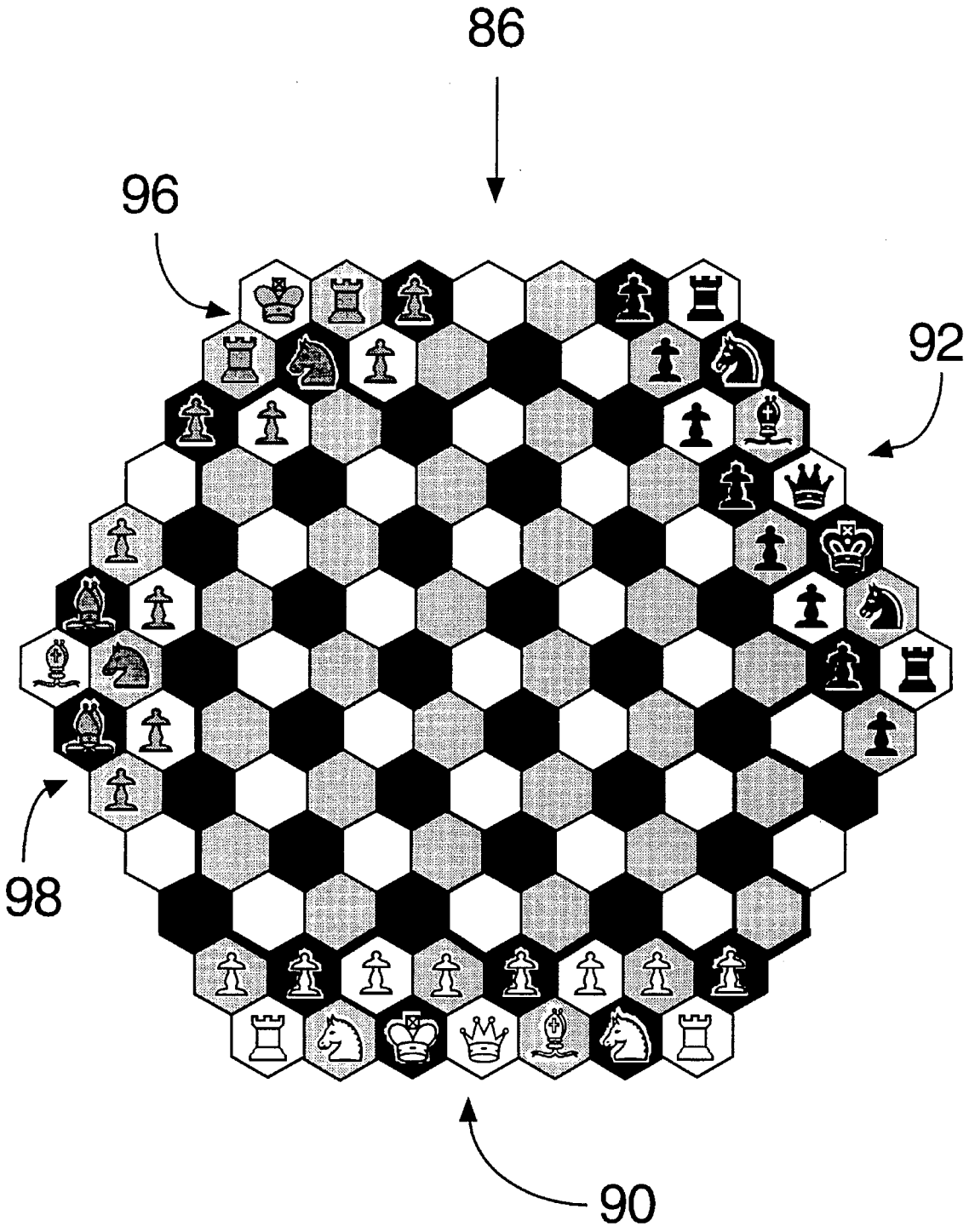
FIG. 16*a–c* show multi-player variations of three-army chess on the multi-player chessboard.
Figure 16B:
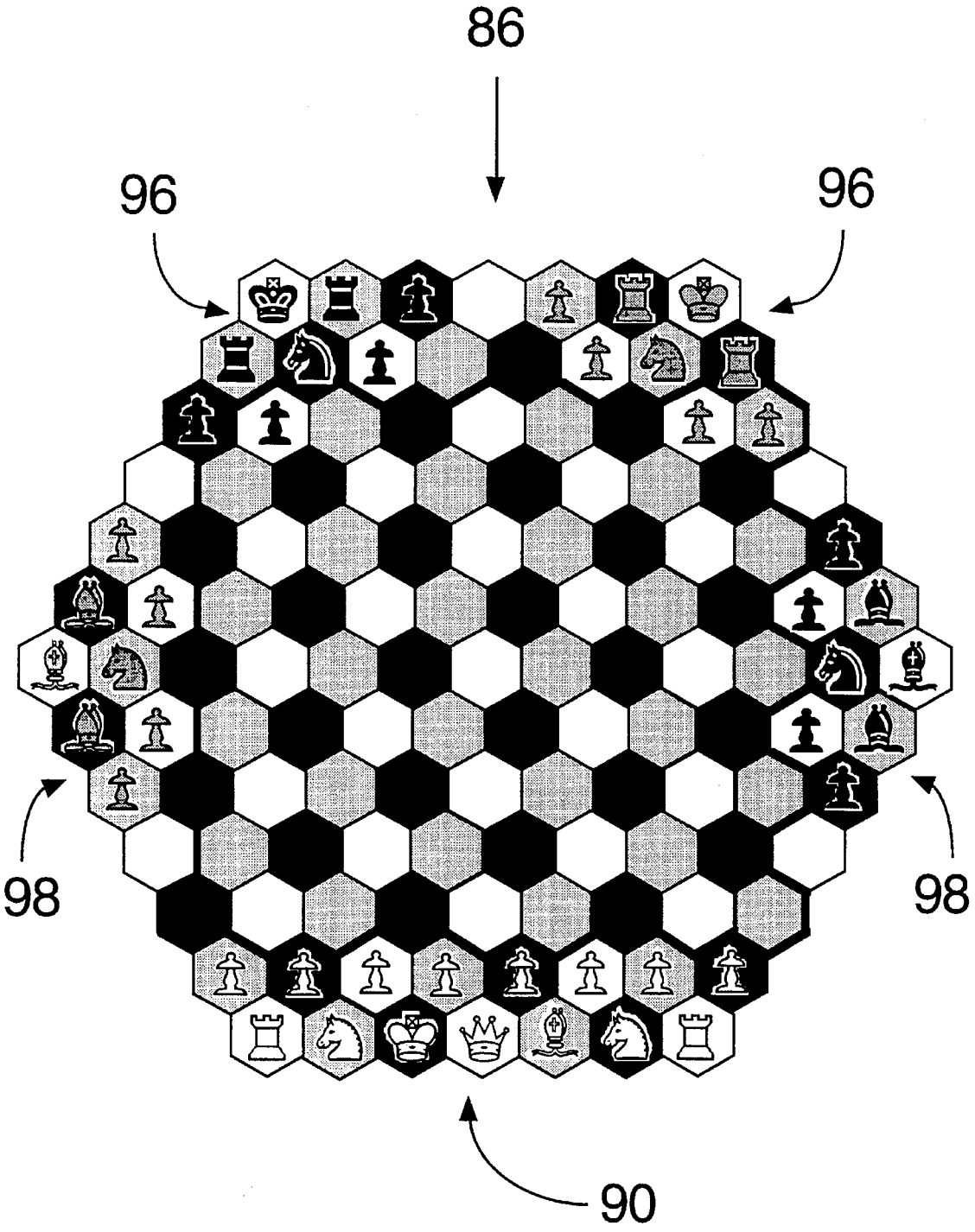
Figure 16C:
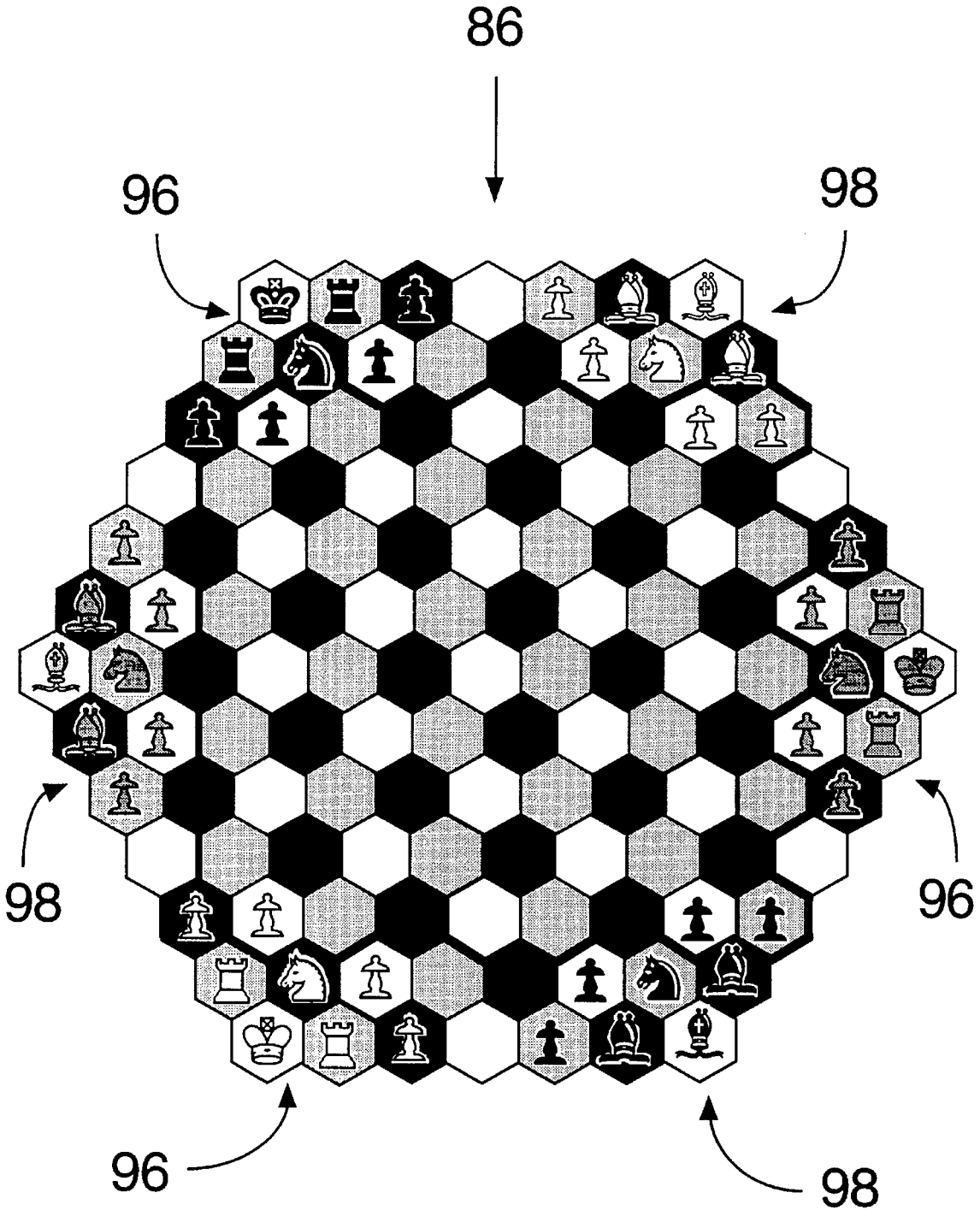

Referring to FIGS. 16*a–c*, multi-player versions of three-army chess on the multi-player chessboard 86 are shown. Normally, three-army chess is played by three contestants, but by dividing armies 90 into partial armies 96,98 corresponding to the number of desired participants, three-army chess may be played by more than three contestants. For example, one of the three armies 90 may be divided in half creating a king's army 96 and a pope's army 98, while the opposing armies 90 remain intact, allowing four players to participate. Two of the three armies 90,92 may be divided, creating two king's armies 96 and two pope's armies 98, while the third army 90 remains intact allowing five players to participate. Finally, each of the three armies 90,92,94 may be divided, creating three king's armies 96 and three pope's armies 98, allowing six players to participate.

Two-Army Chess

Figure 17:
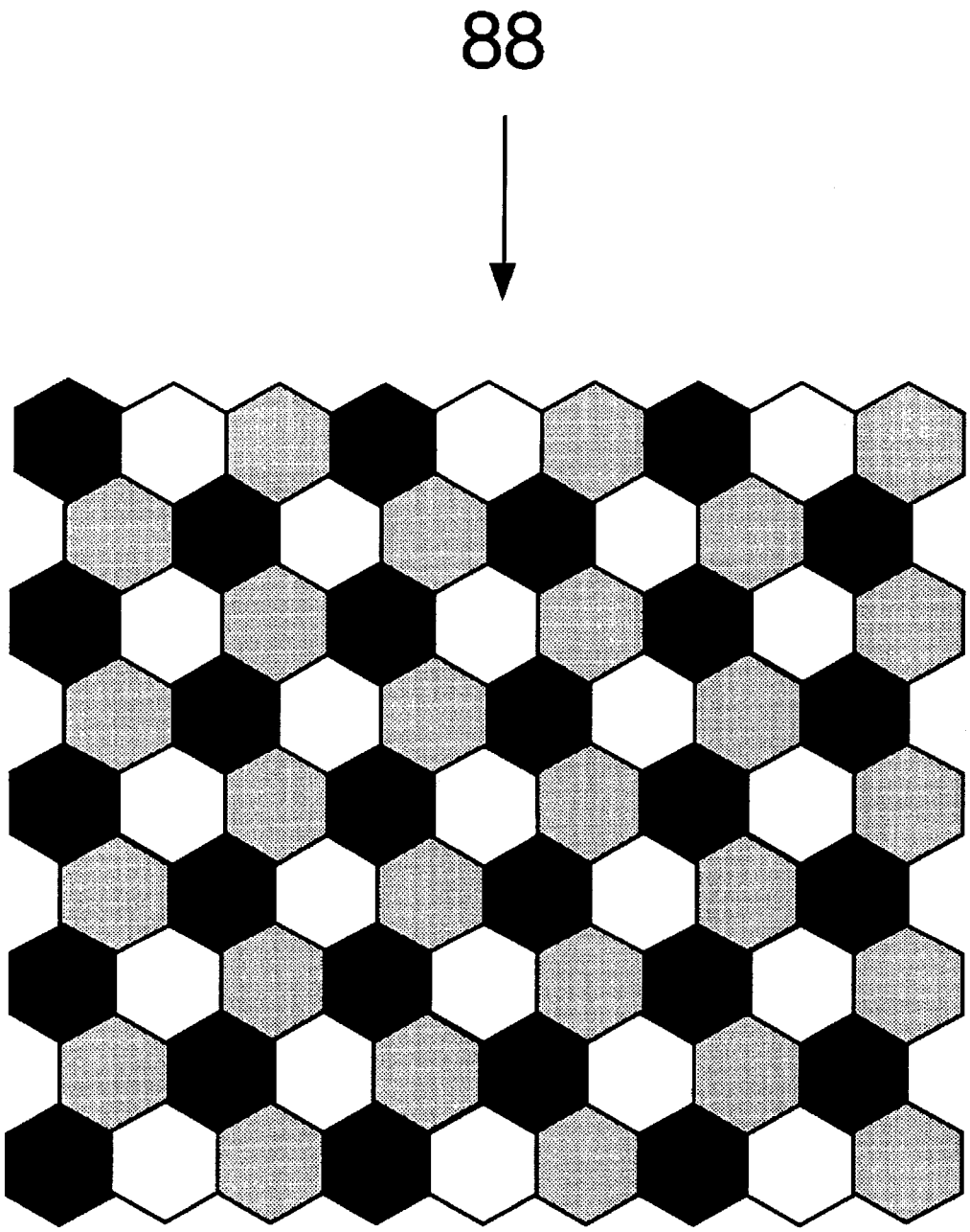
FIG. 17 shows the rectangular circumscribed area of the multi-player chessboard.

Referring to FIGS. 17 and 10, two-army chess is played within the rectangular circumscribed area 88 of the multi-player chessboard 86. Besides being historically rooted in the events of the Great Schism, when each of two Popes claimed the right to the Papacy, two-army chess is intended to provide a practical means by which participants may compete in a two-army game involving elements of multi-player chess, thereby increasing the skills necessary for the playing of multi-player chess. Thus, aforementioned relationships are altered in two-army chess; i.e., forward movement consists of two (n) possible directions of movement, not (n–1) as in multi-player chess in general.

Figure 18:
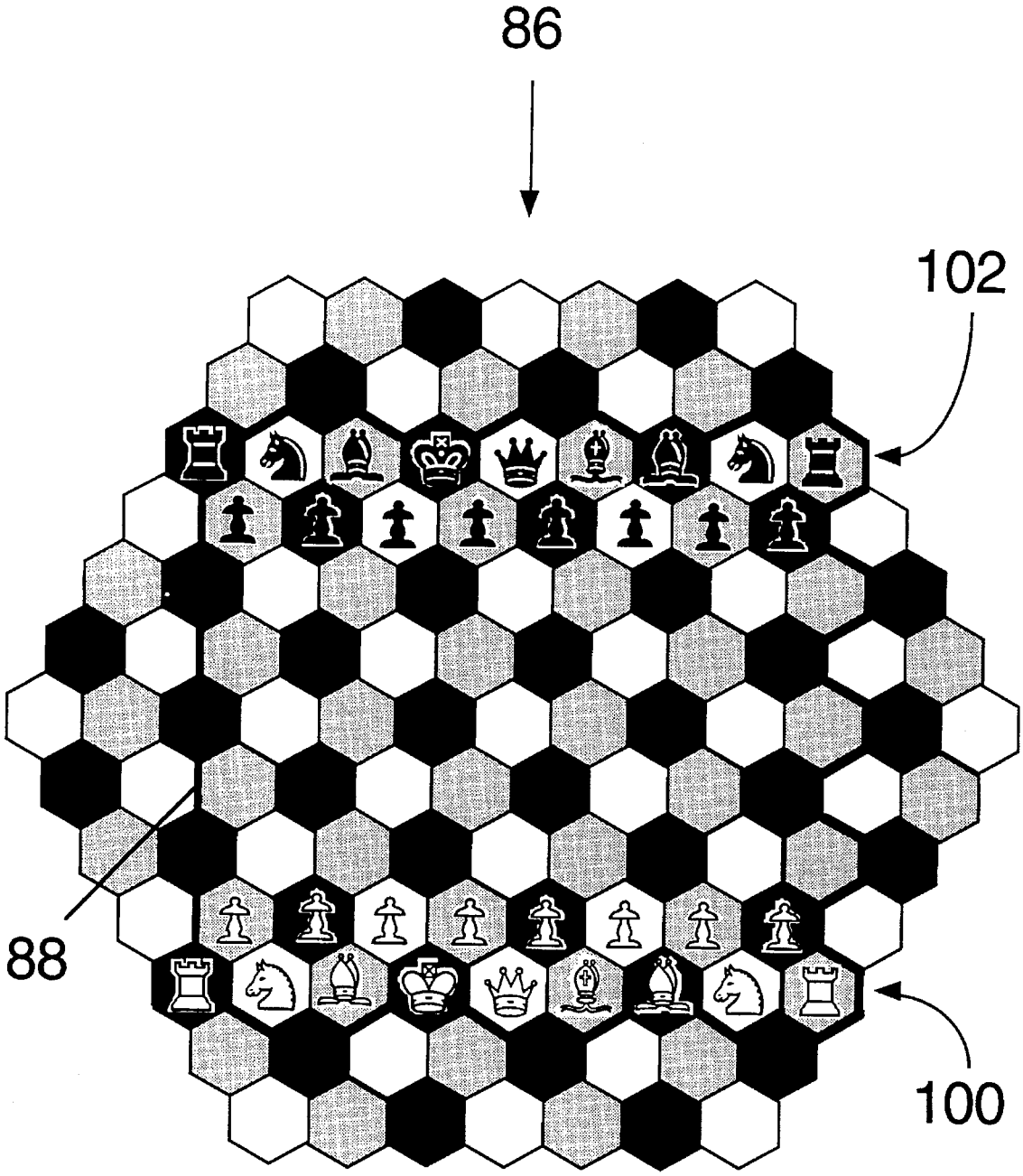
FIG. 18 shows two armies of chessmen in an initial array on the rectangular circumscribed area of the multi-player chessboard.
Figure 19:
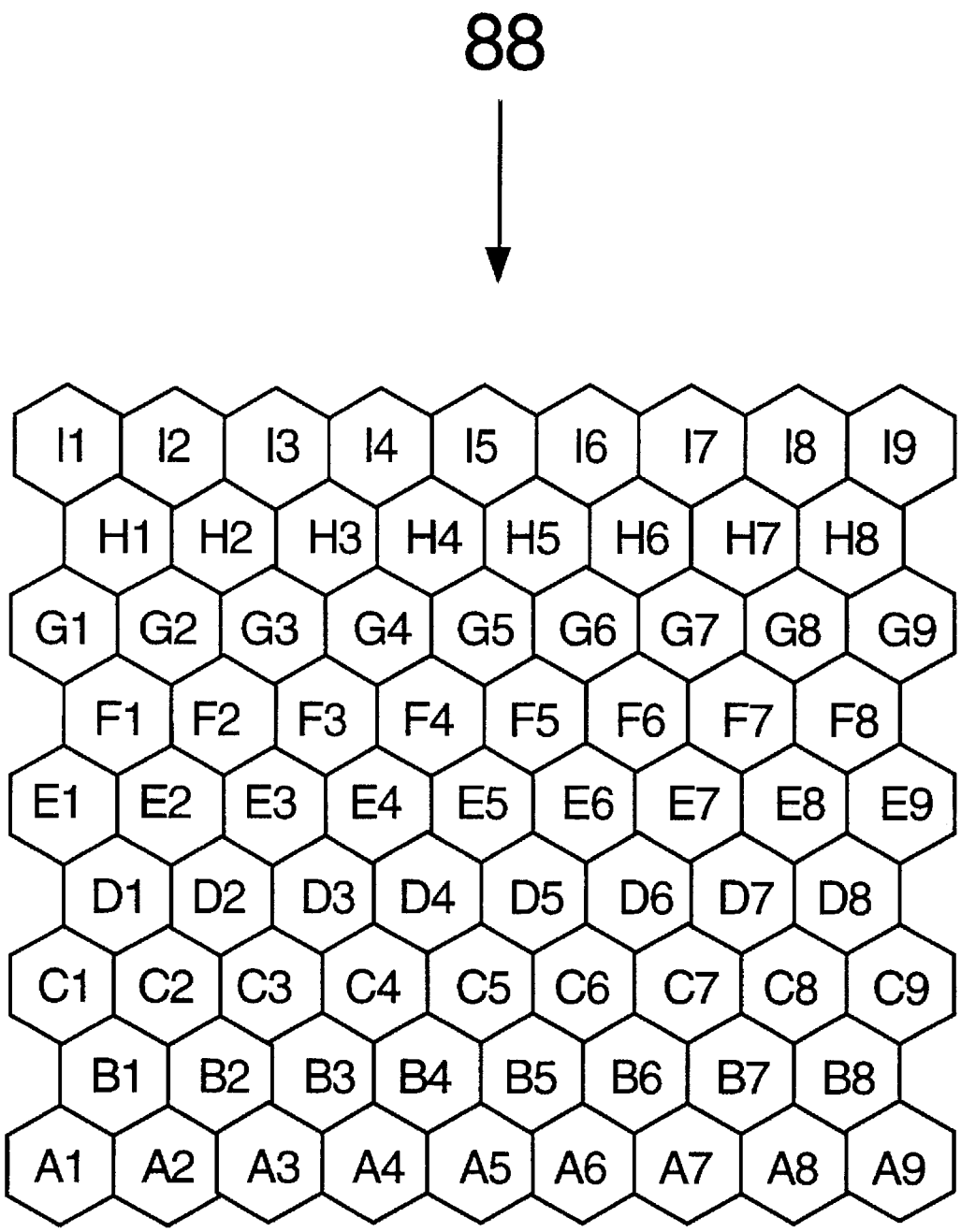
FIG. 19 shows playing spaces of the rectangular circumscribed area labeled on the multi-player chessboard.
Figure 20A:
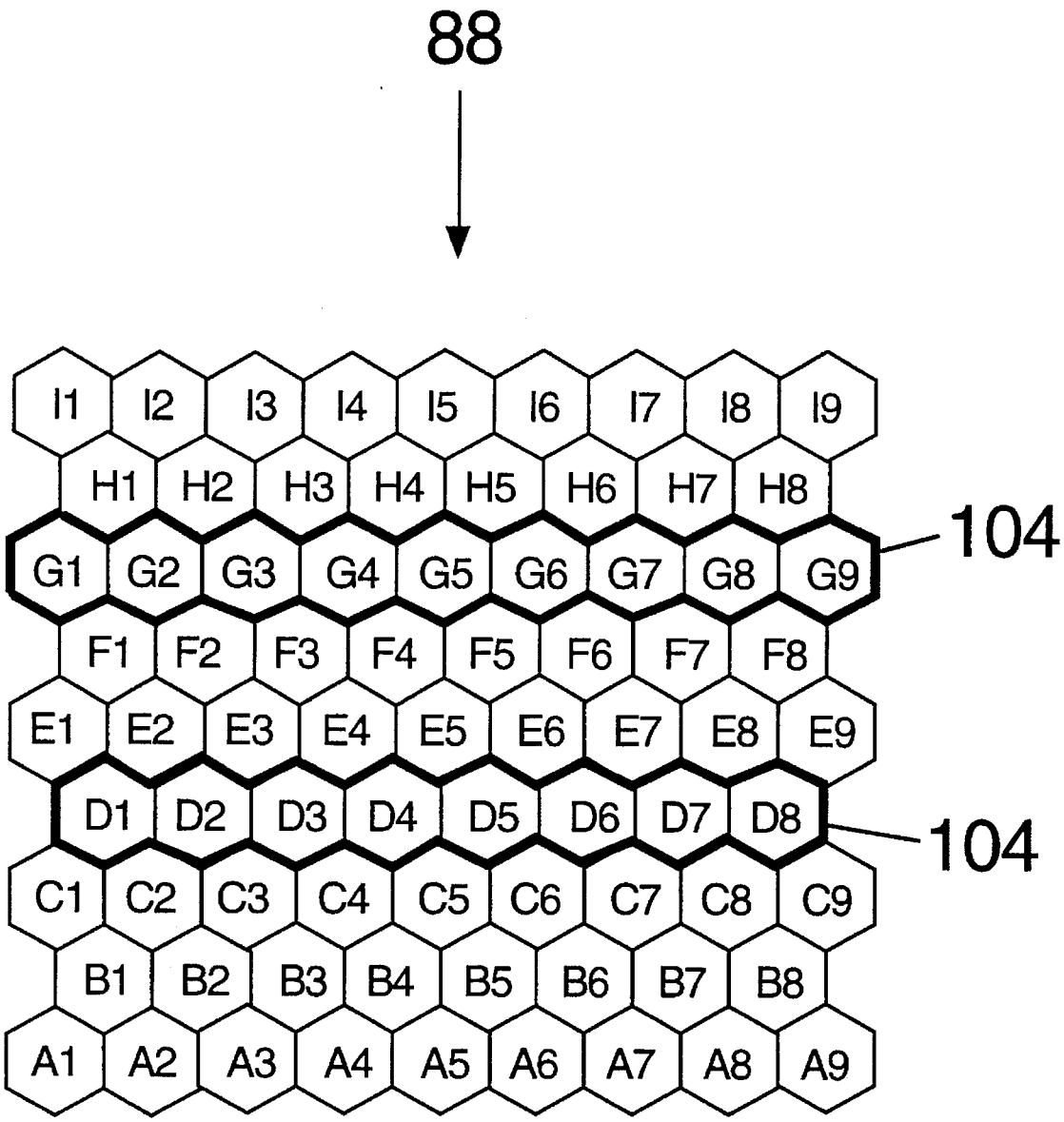
FIGS. 20*a–b* show parallel ranks identified on the rectangular circumscribed area of the multi-player chessboard.
Figure 20B:
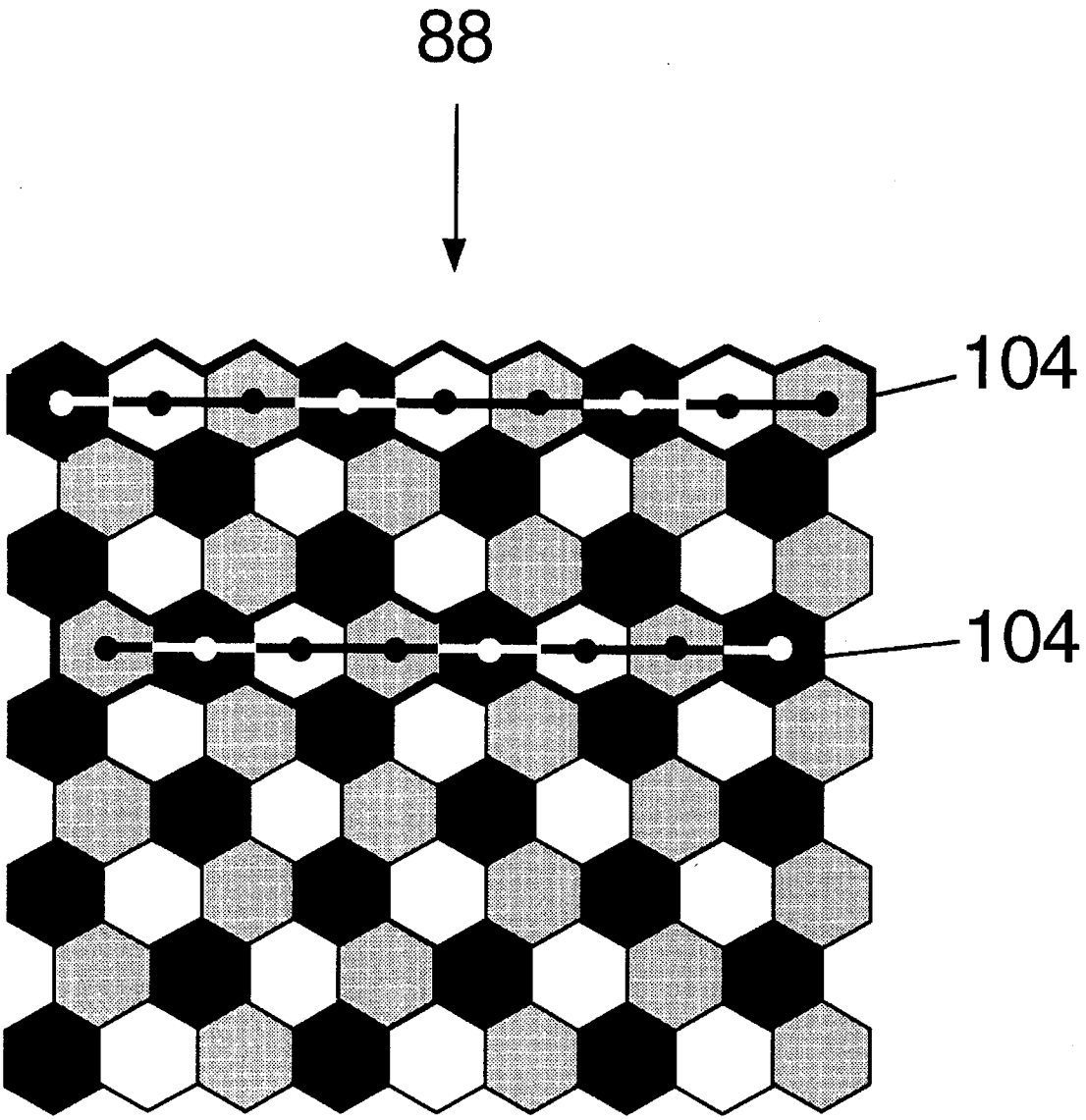
Figure 21A:
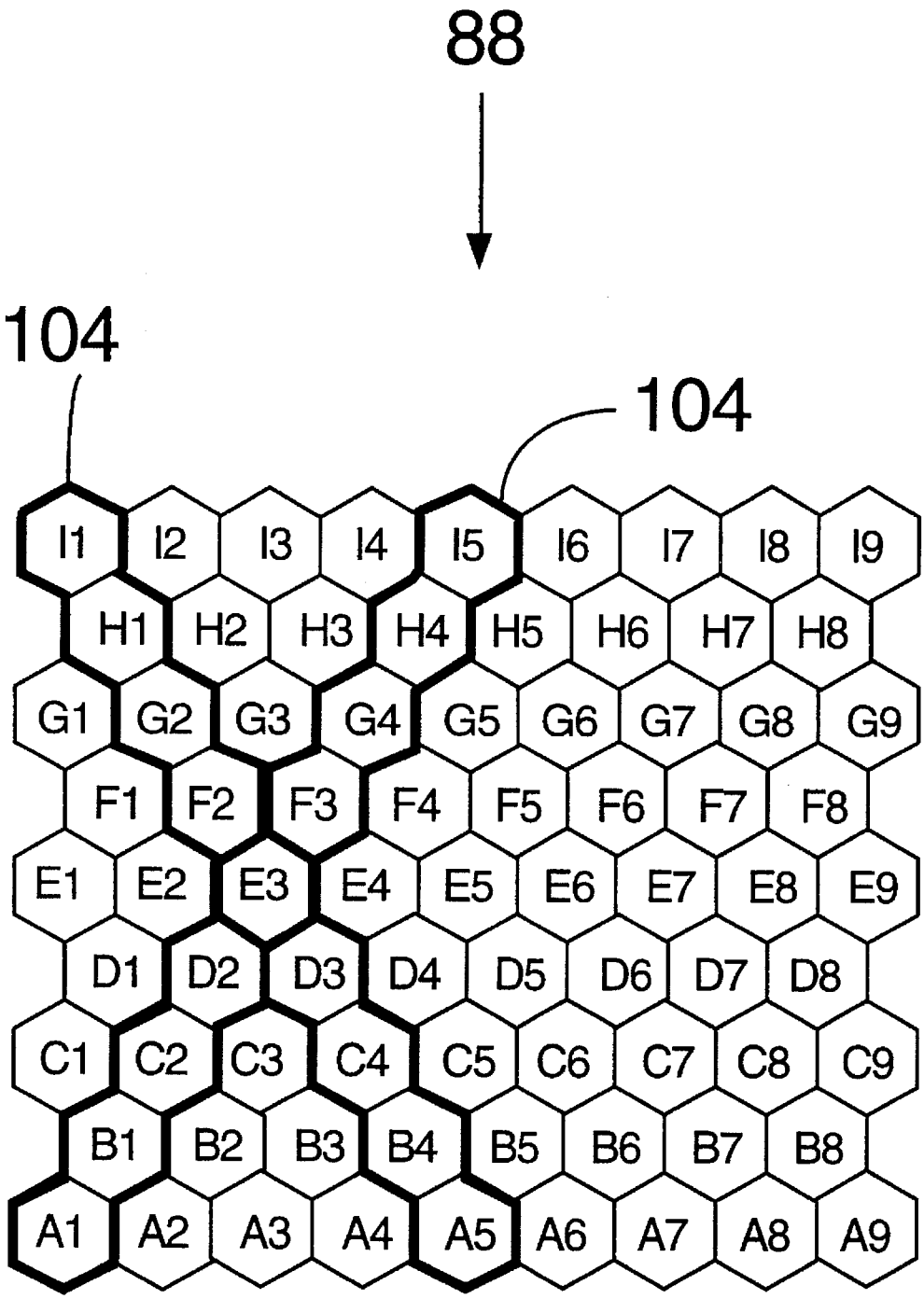
FIGS. 21*a–b* show diagonal ranks identified on the rectangular circumscribed area of the multi-player chessboard.
Figure 21B:
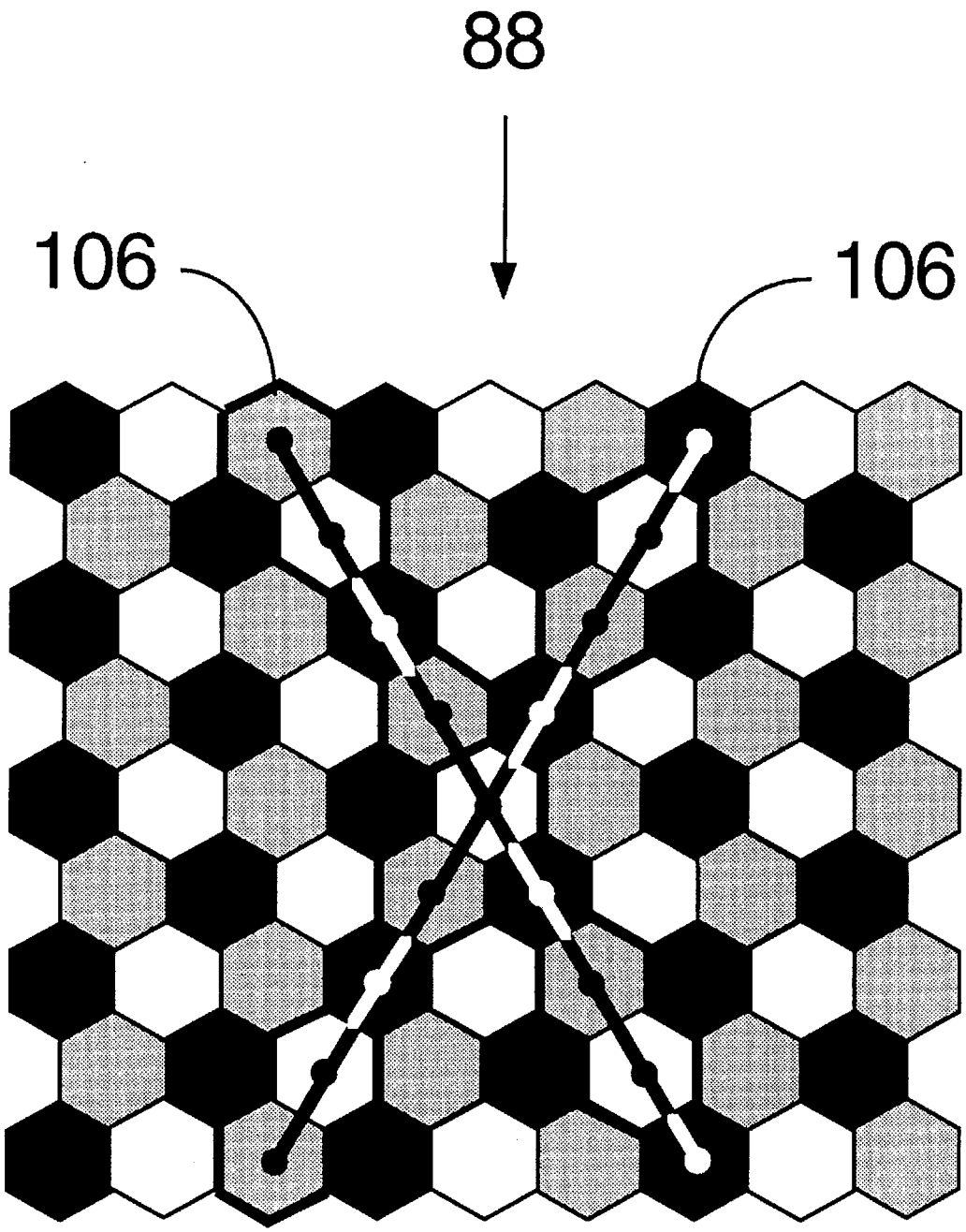

Referring to FIG. 18, initial placement of two-army chessmen 100, 102, consisting of two armies 64 of multi-player chessmen 66 on the rectangular circumscribed area 88 of the multi-player chessboard 86 is shown.

Referring to FIGS. 19, 1, 2*a*,and 20*a–b*, the rectangular circumscribed area 88 of the multi-player chessboard 86 is mapped algebraically beginning with the first rank 60 on the white army's 100 side. Letters (A–I) are used to identify parallel ranks 104, and hexagonal spaces 52 in each parallel rank 104 are numbered from left to right with numbers (one through eight or nine). Parallel ranks 104 are numbered (one through five) for each army 104, and the fifth parallel rank 104 is shared by both players.

Referring to FIGS. 20*a*–21*b*, 2*a* and 1, specific examples of ranks 60 on the rectangular circumscribed area 88 of the multi-player chessboard 86 are now described. The rank 60 spanning the rectangular circumscribed area 88 of the multi-player chessboard 86 from (G1–G9) is a parallel rank 104; (D1–DS) is a parallel rank 104. The rank 60 spanning the rectangular circumscribed area 88 of the multi-player chessboard 86 from (A1–I5) is a diagonal rank 106, (I1–A5) is a diagonal rank 106.

Figure 22:
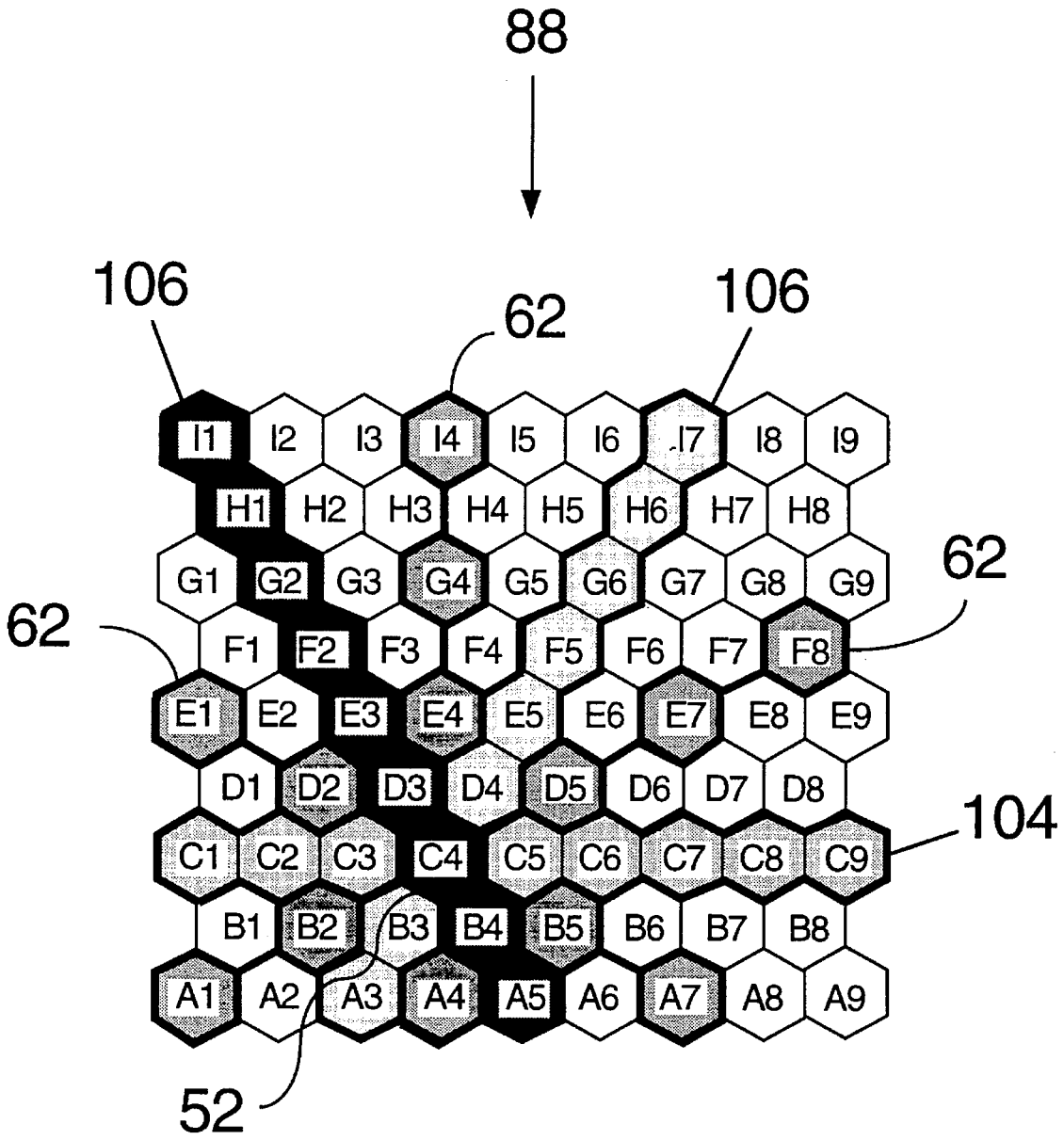
FIG. 22 shows the spatial identity of a single space on the rectangular circumscribed area of the multi-player chessboard.

Referring to FIG. 22, the spatial relationship of one hexagonal space 52, (C4), to each army 100, parallel ranks 104, and files 62 is as follows. Hexagonal space 52 (C4) is included in white's third rank 104 and black's seventh rank 104. Hexagonal space 52 (C4) is included in the diagonal ranks 106 (A3–I7), and (A5–I1). Finally, (C4) is included in the files 62 (A4–I4), (A1–F8), and(A7–I1).

Two-army chessmen 100, 102 are composed of two armies 64 of traditional chessmen with the addition to each army 100, 102 of a chessman called a pope 70, which functions as a second checkmate target, allowing participants to compete in a two-army chess game which increases skills necessary for multi-player chess. Typically, the white army 100 begins the game, and the two armies 100, 102 alternate making moves one at a time.

Figure 23:
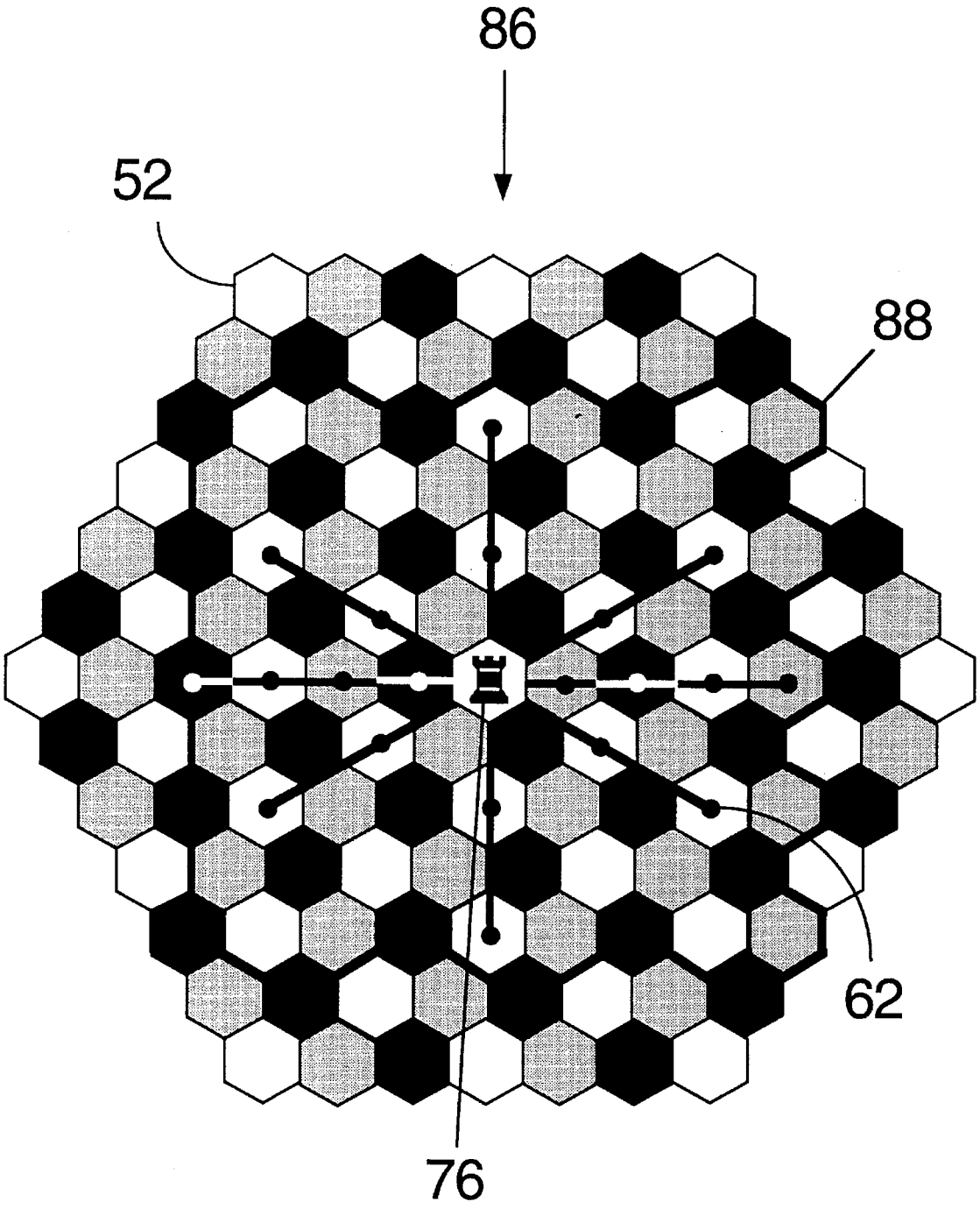
FIG. 23 shows two-army rook movements on the rectangular circumscribed area of the multi-player chessboard.

Referring to FIG. 23, the two-army rook 76 can move to any hexagonal space 52 so far as it is unobstructed on the rank 60 or file 62 on which it stands. The two-army rook 76 thus has eight possible directions of movement. A two-army rook 76 is blocked on a file 62 when a hexagonal space 52 adjacent to two hexagonal spaces 52 of a file are occupied.

Figure 24:
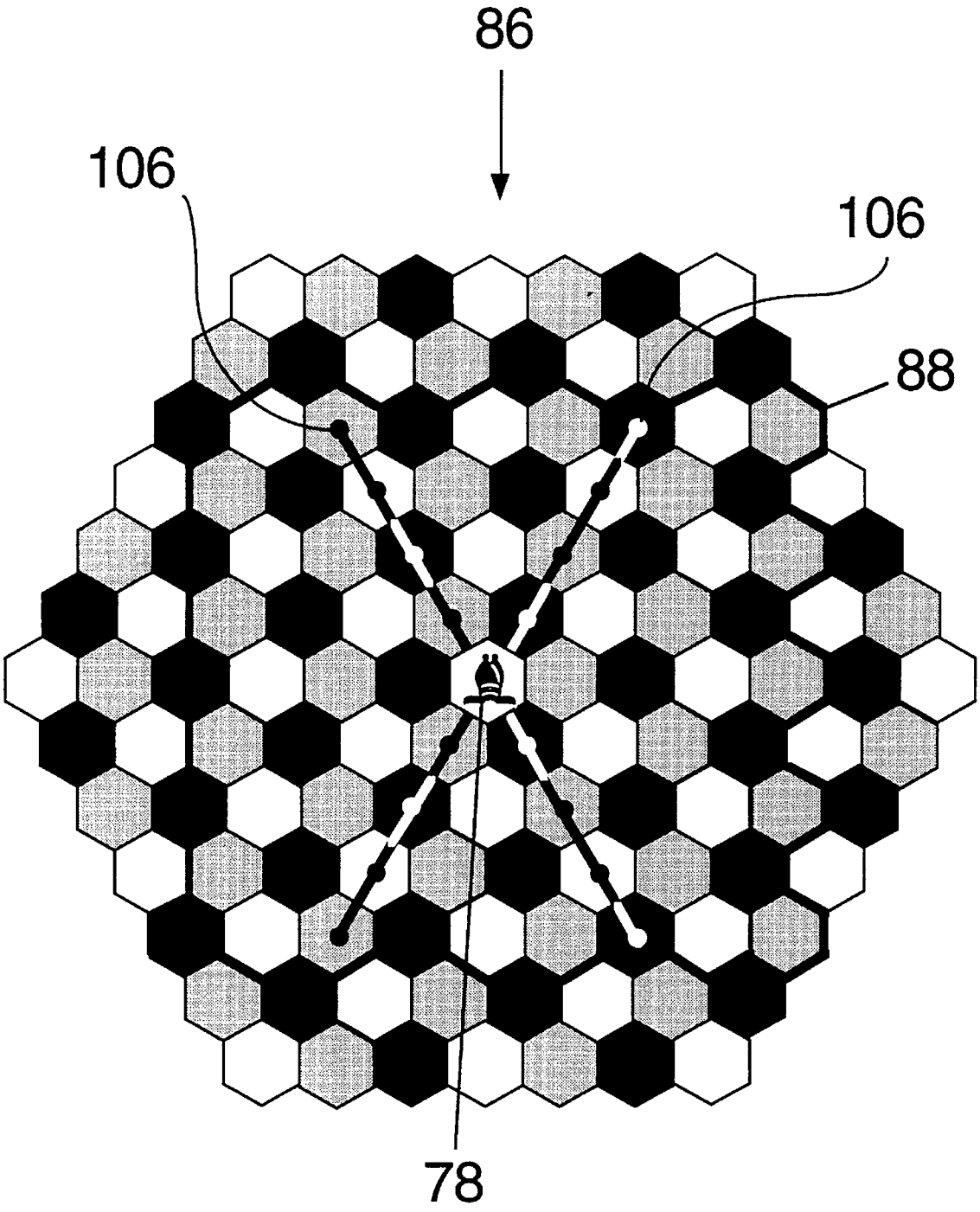
FIG. 24 shows two-army bishop movements on the rectangular circumscribed area of the multi-player chessboard.

Referring to FIG. 24, the two-army bishop 78 moves in any of four directions so far as it is unobstructed along either of the diagonal ranks 106 on which it stands.

Figure 25:
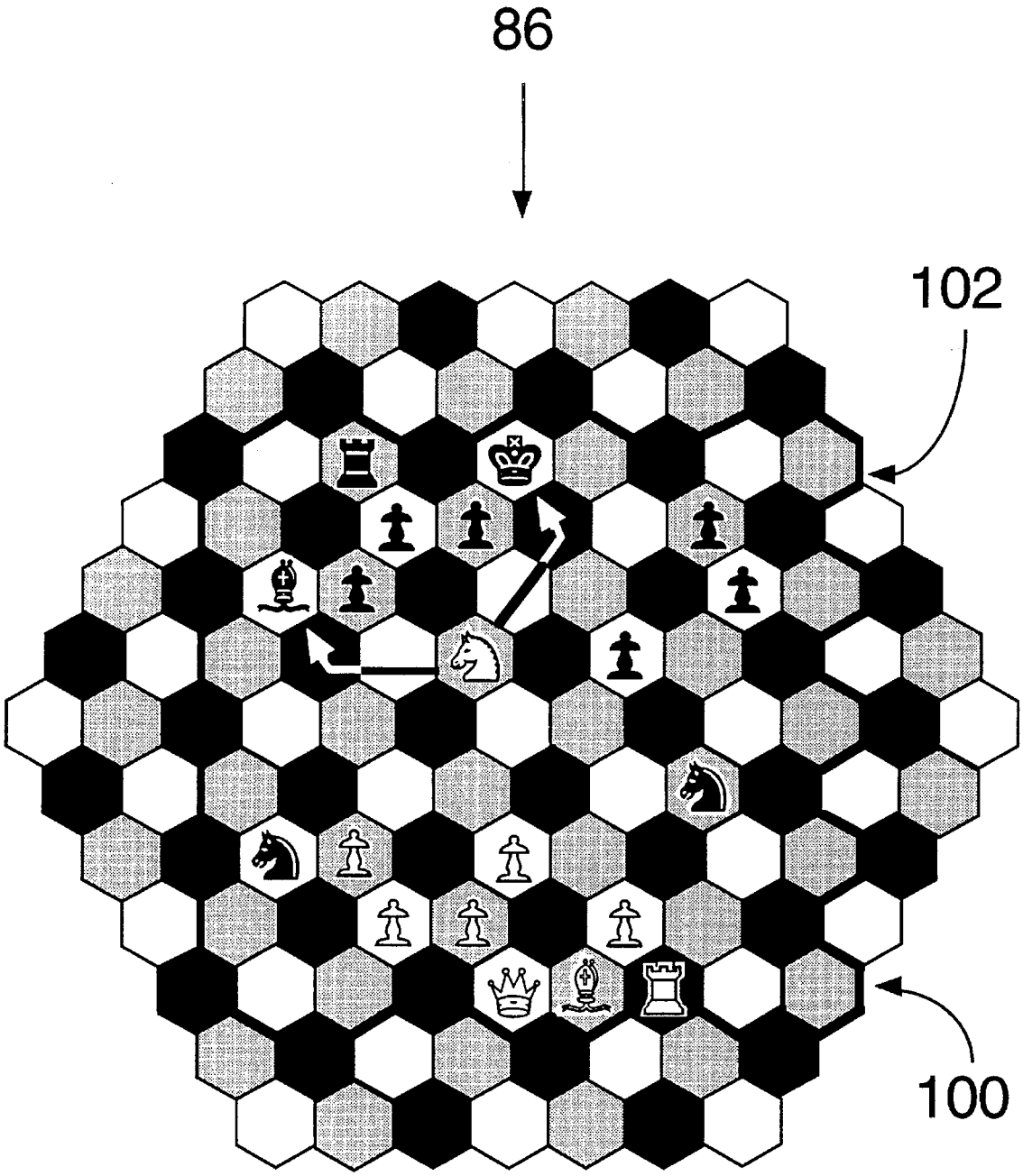
FIG. 25 shows a two-army double check on the rectangular circumscribed area of the multi-player chessboard; and, FIG. 26 shows a multi-player variation of two-army chess on the rectangular circumscribed area of the multi-player chessboard.

Referring to FIG. 25, the white army 100 accomplishing a double check of the black army 102 is shown.

Each army 100 may check and capture or checkmate the opposing army's 102 pricipal elements 69 in any order. An army 100 wins two-army chess when the army 100 captures the king 68 of the opposing army 102 and then checkmates the pope 70 of the opposing army 102 or vice versa. An army 100 can also win if the opposing army 102 resigns the game.

Figure 26:
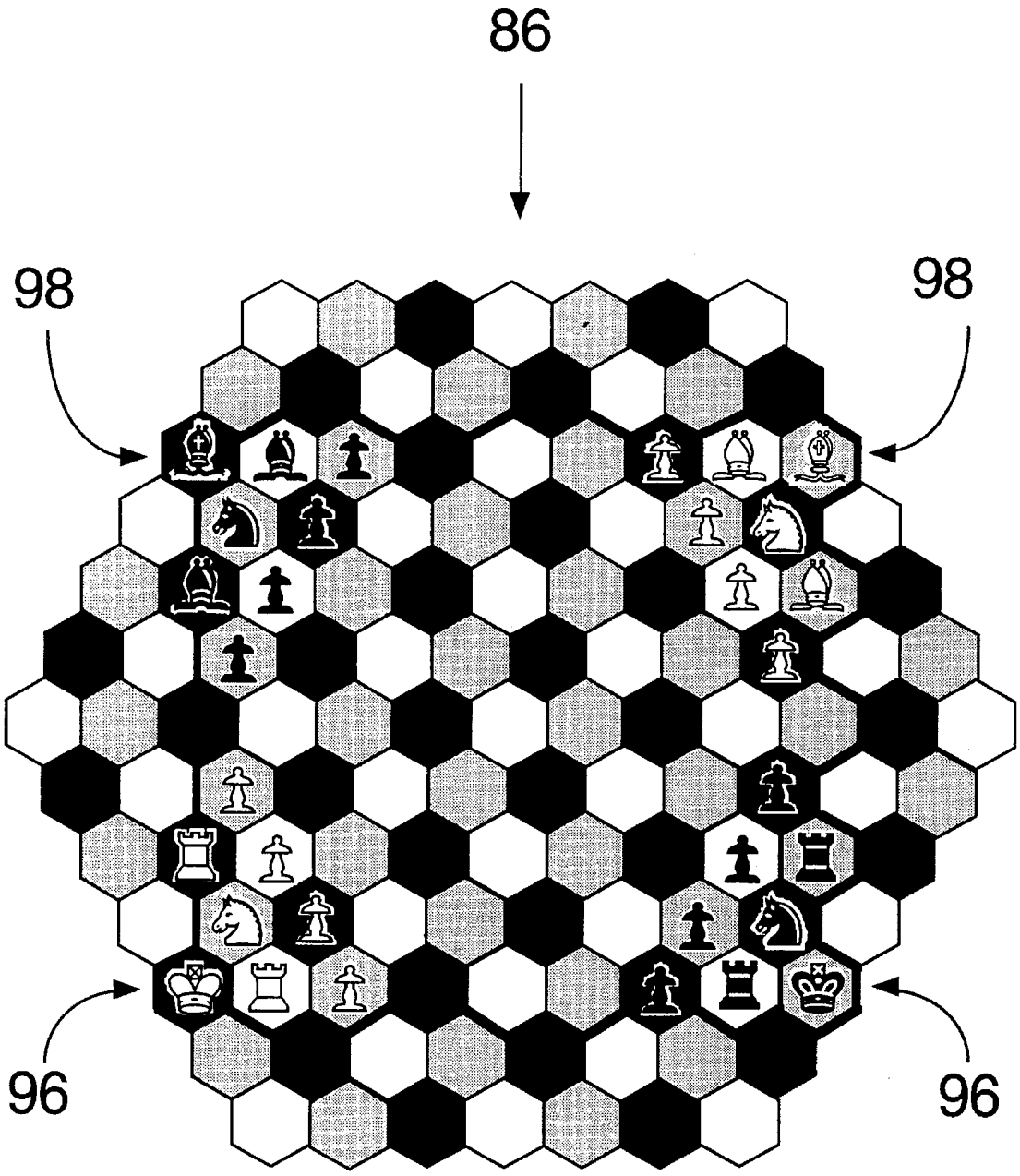

Referring to FIG. 26, a multi-player version of two-army chess is shown. Normally, two-army chess is played by two contestants, but by dividing armies 100 into partial armies 96,98 corresponding to the number of desired participants, two-army chess may be played by more than two contestants. For example, one of the two armies 100 may be divided in half creating a king's army 96 and a pope's army 98, while the second army 102 remains intact, allowing three players to participate. Both armies 100,102 may be divided, creating two king's armies 96 and two pope's armies 98, allowing four players to participate.

What is claimed is:

1. A method of playing chess with three or more players, comprising the steps of:

(a) providing a playing surface composed of a plurality of polygonal spaces wherein each polygonal space is colored sequentially according to the number of sides on the polygonal space;

(b) providing an army and at least two opposing armies of chessmen arranged on the playing surface wherein the army and the opposing armies each have pawns, knights, rooks, bishops, a queen, a king, and a number of additional chessmen equal to the number of opposing armies minus one wherein the king and additional chessman are principal chessmen; and, (c) maintaining unique checkmate targets established on a one to one correspondence between the army and the at least two opposing armies, requiring the army to neutralize one principal chessman from each of the opposing armies to win a game.

2. The method of playing chess with three or more players as in claim 1 wherein the plurality of polygonal playing spaces are arranged forming the playing surface substantially in the same shape as each polygonal space.

3. The method of playing chess with three or more players as in claim 1 wherein the relationship of polygonal space sides to number of players, playing surface patterns to number of players, playing surface sides to number of players, and polygonal space patterns to number of players is equivalent to the same relationships in traditional chess.

4. The method of playing chess with three or more players as in claim 1 wherein the pawns, knights, rooks, bishops, queens, kings, and additional chessmen maintain ratios of number of moves to polygonal space sides that are equivalent to the same ratios in traditional chess.

* * * * *